US009392829B2

(12) United States Patent
Manuello

(10) Patent No.: US 9,392,829 B2
(45) Date of Patent: Jul. 19, 2016

(54) MAGNETIC CLASP DEVICE FOR CLOTHING ACCESSORIES

(76) Inventor: Gerarld Manuello, Groslay (FR)

( * ) Notice: Subject to any disclaimer, the term of this patent is extended or adjusted under 35 U.S.C. 154(b) by 0 days.

(21) Appl. No.: 13/503,597

(22) PCT Filed: Oct. 25, 2010

(86) PCT No.: PCT/FR2010/052281

§ 371 (c)(1),
(2), (4) Date: Apr. 23, 2012

(87) PCT Pub. No.: WO2011/048344

PCT Pub. Date: Apr. 28, 2011

(65) Prior Publication Data

US 2012/0216374 A1 Aug. 30, 2012

(30) Foreign Application Priority Data

Oct. 23, 2009 (FR) ..... 09 05109

(51) Int. Cl.
*A44B 11/25* (2006.01)
*A41F 1/00* (2006.01)
(Continued)

(52) U.S. Cl.
CPC ..... *A41F 1/002* (2013.01); *A41F 9/002* (2013.01); *A45C 13/1069* (2013.01); *A44D 2203/00* (2013.01); *Y10T 24/32* (2015.01)

(58) Field of Classification Search
CPC ..... A41F 1/002; A41F 9/002; A45C 13/1069; A44D 2203/00
USPC ..... 24/303
See application file for complete search history.

(56) References Cited

U.S. PATENT DOCUMENTS 2,389,298 A 3/1943 Ellis
3,141,216 A * 7/1964 Haskell ..... 24/303
(Continued)

FOREIGN PATENT DOCUMENTS

DE 3736254 A1 5/1989
WO 2005/058087 A1 6/2005

OTHER PUBLICATIONS

International Searech Report issued Jan. 17, 2011 by European Patent Office re: PCT/FR2010/052281, pp. 3; citing: WO 2005/058087 A1, U.S. Pat. No. 2,389,298 A, US 2005/177985 A1, U.S. Pat. No. 4,941,236 A, U.S. Pat. No. 5,307,582 A and DE 37 36 254 A1.

*Primary Examiner* — Robert J Sandy
*Assistant Examiner* — David Upchurch
(74) *Attorney, Agent, or Firm* — Cantor Colburn LLP

(57) ABSTRACT

A device for magnetic clasping for a clothing accessory includes at least one permanently magnetized assembly arranged at one end of one surface of the accessory, while a plurality of ferromagnetic elements and/or permanently magnetized assemblies are arranged longitudinally on the other surface at the opposite end thereof. The magnetized assemblies of one surface are suitable for attracting a magnetized assembly of the other surface. The magnetized assemblies and/or ferromagnetic elements of each surface are arranged such that, by placing the ends of the surfaces vertically adjacent to one another, a plurality of adjustment positions of the surfaces are obtained relative to the position of the magnetized assemblies and ferromagnetic elements, representing a plurality of possible tightness levels. Each magnetized assembly of one surface engages with a magnetized assembly or a ferromagnetic element of the other surface in each one of the adjustment positions to close any magnetic field.

4 Claims, 13 Drawing Sheets

(51) Int. Cl.
*A41F 9/00* (2006.01)
*A45C 13/10* (2006.01)

(56) References Cited

U.S. PATENT DOCUMENTS 3,372,443 A * 3/1968 Daddona, Jr. ..... 24/303
4,265,002 A * 5/1981 Hosken ..... 24/303
4,399,595 A * 8/1983 Yoon et al. ..... 24/303
4,453,294 A * 6/1984 Morita ..... 24/303
4,736,494 A * 4/1988 Marchesi ..... 24/303
4,941,236 A 7/1990 Sherman
5,307,582 A 5/1994 Quintel
5,933,926 A * 8/1999 Reiter ..... 24/303
6,163,938 A * 12/2000 Weber-Unger ..... 24/303
6,170,131 B1 * 1/2001 Shin ..... 24/303
6,226,842 B1 * 5/2001 Wong ..... 24/303
6,892,428 B2 * 5/2005 Reiter ..... 24/303
7,065,841 B2 * 6/2006 Sjoquist ..... 24/303
7,178,207 B2 * 2/2007 Wong et al. ..... 24/303
2003/0005558 A1 * 1/2003 Wong ..... 24/303
2005/0177985 A1 * 8/2005 Sjoquist ..... 24/104
2007/0124898 A1 * 6/2007 Clark ..... 24/303

* cited by examiner

Fig. 9b
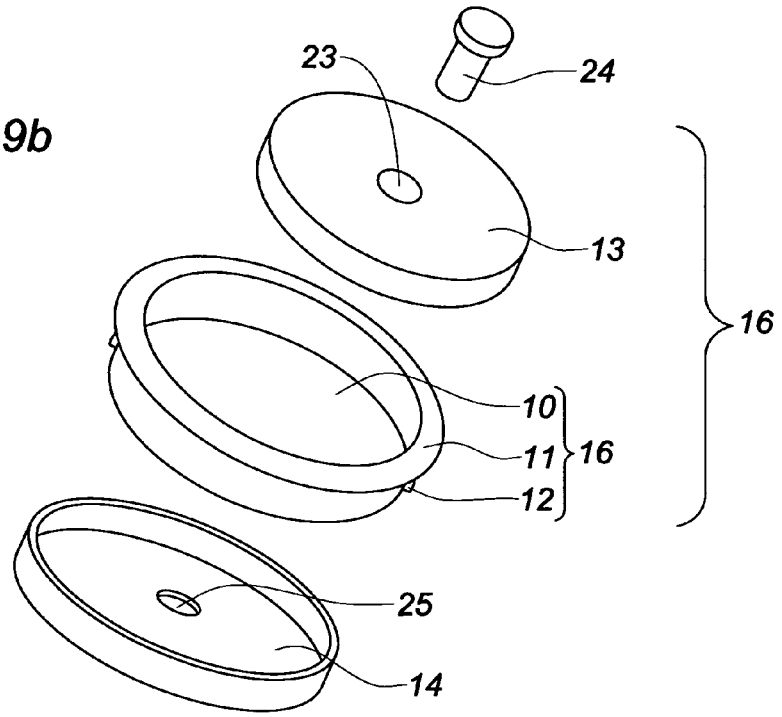
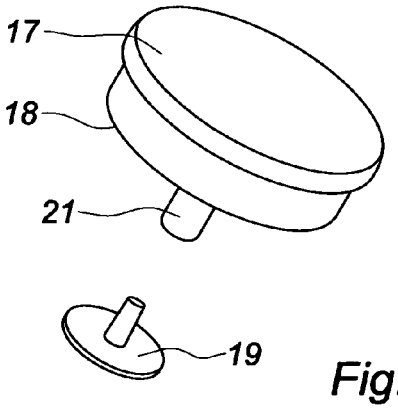
Fig. 10b

MAGNETIC CLASP DEVICE FOR CLOTHING ACCESSORIES

TECHNICAL FIELD

The present invention relates to a magnetic clasp device for clothing accessories, for example for belts.

BRIEF DISCUSSION OF RELATED ART

Regarding belts, and in particular buckle belts, it has been observed that fastening a buckle belt is not always very easy when the leather of the belt is too stiff or the holes for adjusting the size of the belt are not well pierced.

In fact, in the context of a traditional buckle belt, with a metal buckle prong, spur or tab, it is difficult to insert said spur or prong into said holes making it possible to adjust the size when the latter are poorly formed.

Furthermore, with time, the most used hole tends to widen, become damaged and deteriorate.

One or more carriers are also necessary and essential to immobilize the end(s) of the belt, depending on the nature of the buckle, once it is closed.

However, these are sometimes necessarily missing, for example when the belt is worn on a dress or sweater.

Positioning a carrier at the proper distance to immobilize the ends of the belts regardless of the adjustment of the size by the user is complex.

In the case of belts or similar devices having integrated stationary carriers, they are not adapted to the size of all people, and if they are movable, over time the leather tends to move and the carrier only maintains the piece of leather at the free end of the belt for a limited period of time.

Also known are a number of magnetic clasp devices making it possible to close a clothing accessory of the belt type such as, for example, magnetic buckle belts.

However, these magnetic buckle belts are not fully satisfactory.

In fact, on the one hand, the magnetic buckle system is often complex to use and, on the other hand, it only has a single fastening point between the two ends of the belt, which causes risks of having the magnets of the system put in place to close the belt jump fairly frequently.

Furthermore, if it is provided to maintain these magnets using a system preventing them from jumping, the removal and opening of the belt then also becomes complicated.

Furthermore, there are many drawbacks that result from using a magnetic clasp on a clothing accessory such as a belt.

Sometimes an attraction of all metal material by the belt is observed.

It is also possible to observe an upset in the operation of active electronic implants, such as pacemakers or defibrillators, and implants that can be activated by applying a magnetic, thereby putting the wearers of the accessory in danger.

In fact, in the magnetic clasp belts of the prior art, the presence of magnets creates outside magnetic fields that interact with elements outside the belt.

Furthermore, most often, the magnets of the metal clasps are also too large and unattractive or too small and ineffective.

Furthermore, whatever the clothing accessory with a magnetic or non-magnetic buckle, the clasp is often very thick and causes awkward shapes that make the figure heavier.

Furthermore, the known magnetic clasp devices do not guarantee quick and simple closing of the clothing accessory.

In fact, insertion difficulties due to poor centering of the component pieces of the device have also been observed in accessories provided with magnetic clasp devices. The user must most often guide the closing of the device to best index the two corresponding magnets.

BRIEF SUMMARY

One aim of the present invention is to propose a magnetic clasp device implementing a magnetic clasp for a clothing accessory that is simple and fast, while simultaneously offering several possibilities for adjusting the size of the clothing accessory.

It is also desirable to offer magnetic clasp devices in which the outside magnetization is minor or nonexistent, such that it cannot interact or interfere with any electronic device and in no way bothers the user during wear.

It is also advantageous to propose a magnetic clasp device in which all of the magnetic fields present are closed irrespective of the adjustment of the size of the clothing accessory.

Another aim of the present invention is to offer clothing accessories whereof the size adjustment is possible without using visible holes in the leather of the clothing accessory.

Another aim of the present invention is to propose a magnetic clasp device allowing the ends of the clothing accessory not to hang and to eliminate the use of carriers.

It is also desirable to offer a magnetic clasp device in which the magnetic clasp means index themselves simply and precisely without guidance from the user in particular.

Another aim of the present invention is to propose a magnetic clasp device for a clothing accessory that is very subtle and discreet.

Another aim of the present invention is to offer magnetic clasp devices that are easy to open and close, but that also hold up for a longer period of time.

To that end, the invention relates to a magnetic clasp device for clothing accessories of the clothing belt type, remarkable in that it includes at least one permanently magnetized assembly arranged at one end of one surface of the accessory, while a plurality of ferromagnetic elements and/or permanently magnetized assemblies are arranged longitudinally on the other surface of the accessory at the opposite end thereof, the permanently magnetized assemblies of one surface being suitable for attracting a permanently magnetized assembly of the other surface, the permanently magnetized assemblies and/or ferromagnetic elements of each surface being arranged such that, by placing the ends of the two surfaces of the clothing accessory vertically adjacent to one another, a plurality of adjustment positions of the two surfaces are obtained relative to the position of the permanently magnetized assemblies and ferromagnetic elements, representing a plurality of possible tightness levels, each permanently magnetized assembly of one surface engaging with a permanently magnetized assembly or a ferromagnetic element of the other surface in each one of the adjustment positions.

Owing to the present invention, any magnetization outside the clothing accessory is eliminated, i.e. irrespective of the adjustment of the size of the clothing accessory, any magnetic field due to the presence of the permanently magnetized assemblies and/or the ferromagnetic elements is closed because owing to that specific arrangement of the elements on either side of each of the surfaces of the accessory, no permanently magnetized assembly is free.

This eliminates any risk of damage to electronic devices or any bother for users.

According to specific embodiments, the magnetic clasp device can include one or more of the following features, considered alone or according to all technically possible combinations:

the permanently magnetized assemblies of one surface being adapted to attract any permanently magnetized assembly of the other surface.

a permanently magnetized assembly includes a permanent magnet positioned at one end of one surface of the accessory, the magnets being fastened so as all to have the same polarity on one surface and opposite polarities from one surface to the other;

several permanent magnets and/or ferromagnetic elements are intended to be placed on each of the two surfaces of the clothing accessory, said magnets or ferromagnetic elements being longitudinally aligned and spaced apart in the same manner from one surface to the other;

a same number of permanent magnets and/or ferromagnetic elements is provided on each of the surfaces of the clothing accessory;

the number of magnets for each surface is larger by at least one unit relative to the number of ferromagnetic elements and the magnets are positioned next to one another starting from each of the free ends of the clothing accessory, such that several adjustment positions are obtained for the two surfaces relative to the position of the magnets and ferromagnetic elements representing several possible tightness levels, in which each magnet is applied on another magnet or ferromagnetic element and at least one magnet of a surface is applied on a magnet of the other surface;

the number of adjustment positions representing the possible tightness levels is equal to the number of ferromagnetic elements of a surface plus one unit;

the magnets and/or ferromagnetic elements are covered with a finishing coating independently of one another and from one surface to the other;

the magnets and/or ferromagnetic elements of one surface are positioned so as to protrude slightly from said surface;

the magnets and/or ferromagnetic elements of one of the surfaces protrude slightly from said surface, while the magnets and/or ferromagnetic elements of the other surface are placed withdrawn from said other surface, such that the magnets and/or ferromagnetic elements of said surface are inserted into the magnets and/or ferromagnetic elements of the other surface thereby benefiting, in addition to their magnetic attraction, from a stop;

the magnets and/or ferromagnetic elements of one of the surfaces protrude slightly from said surface, while at least one magnet and/or ferromagnetic element of the other surface is provided with an edge protruding from said other surface, such that at least one magnet and/or ferromagnetic element of said surface can be inserted into a magnet and/or ferromagnetic element of said other surface, in addition to their magnetic attraction;

each magnet is fastened in an open receptacle preferably made from a ferromagnetic material;

the receptacles provided with magnets and/or ferromagnetic elements are fastened on the clothing accessory with non-magnetic parts;

the magnets and/or ferromagnetic elements are positioned in holes formed in the clothing accessory;

a permanently magnetized assembly including a double receptacle adapted to receive a permanent magnet;

the device is adapted for a belt or clothing accessory provided with a buckle making it possible to close it at one of its ends, in said device at least one magnet is arranged on the upper portion of the belt, which is the portion made to pass through the buckle, and ferromagnetic elements are provided in the lower portion, so as to make it possible to maintain the end of the belt once it is passed into the buckle, whether it passes above or below said buckle;

at least one magnet is fastened on the end of the belt or accessory having size adjustment holes, while on the other surface and starting from the end provided with the buckle, ferromagnetic elements are secured longitudinally in a number equal to or greater than the number of size adjustment holes;

a first ferromagnetic element, or the closest to the buckle, is positioned as a function of the arrival of the end provided with the magnet, once passed into the buckle and in the first size adjustment hole, the other ferromagnetic elements being spaced apart from one another identically to said holes, such that the magnet can be magnetically applied on a ferromagnetic element irrespective of the hole used, so as to obtain magnetic maintenance of the end of the belt or accessory once it is passed in the buckle and irrespective of the nature thereof;

the distance between the center of the magnet and the center of the first size adjustment hole is substantially equal to the distance between the center of the first ferromagnetic element and the arrival of a prong on the buckle in the closed position, or between the center of the first ferromagnetic element and a spur of the buckle, depending on the nature of the buckle;

the receptacles of each of the surfaces protrude from the corresponding surface and the device including at least one more receptacle than there are ferromagnetic elements, the receptacle closest to the ferromagnetic elements is the only one adapted to allow the insertion of the receptacles protruding from the opposite surface;

the device comprises a first permanently magnetized assembly adapted to cooperate with the second permanently magnetized assembly, these permanently magnetized assemblies each including a permanent magnet fastened so as to have the same polarity on the visible surface thereof, the first and second permanently magnetized assemblies being designed so as to attract one another;

the first permanently magnetized assembly and the second permanently magnetized assembly also respectively each include a receptacle, partially or completely ferromagnetic, said receptacle being designed so as to support the magnet of the first permanently magnetized assembly and the magnet of the second permanently magnetized assembly, respectively, and to cooperate with the magnet, respectively, of the second permanently magnetized assembly and the first permanently magnetized assembly when the device is closed;

the first permanently magnetized assembly includes a cylindrical permanent magnet and the second permanently magnetized assembly includes a permanent magnet having a through opening adapted to allow the magnet of the first permanently magnetized assembly to be inserted;

the permanent magnets of the first and second permanently magnetized assemblies, respectively, have an axial magnetization as well as an identical height, or are fastened so as preferably to have an identical height;

the first and second permanently magnetized assemblies also each include a paramagnetic element respectively arranged on the outer periphery of the cylindrical magnet and the outer periphery of the opening of the magnet.

BRIEF DESCRIPTION OF THE DRAWINGS

Other aspects, aims and advantages of the invention will appear upon reading the following detailed description of preferred embodiments thereof, provided as non-limiting examples and done in reference to the appended drawings, in which:

FIGS. 9*a* and 9*b* are cross-sectional and exploded perspective views, respectively, of one embodiment of a permanently magnetized assembly the a visible magnetic clasp device of the belt of FIG. 8;

FIGS. 10*a* and 10*b* are cross-sectional and exploded perspective views, respectively, of one embodiment of a ferromagnetic piece of the visible magnetic clasp device of the belt of FIG. 8;

DETAILED DESCRIPTION

A magnetic clasp device according to the present invention will be described in several embodiments, in reference to a leather clothing belt.

However, such a magnetic clasp device may be placed in any type of clothing accessory or item having suitable characteristics, i.e. two pocket flaps of a certain length made to close and the size of which is intended to be adjusted.

Non-limiting examples of the present invention include jewelry, bracelets, necklaces, bags, pants, dresses and/or sweaters.

Such a magnetic clasp device can also be fastened on any type of material other than leather supporting it.

Figure 1A:
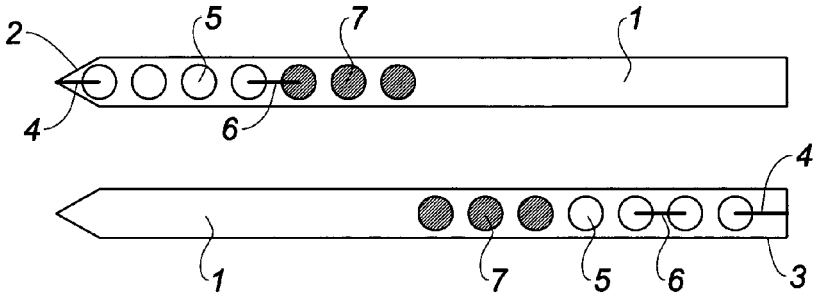
FIGS. 1*a* and 1*b* are views of each of the surfaces of a belt provided with a hidden magnetic clasp device according to one embodiment of the present invention, before and after deposition of a finishing leather on the belt, respectively.
Figure 1B:
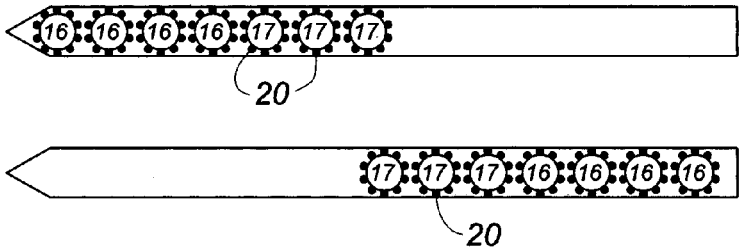
Figure 2:
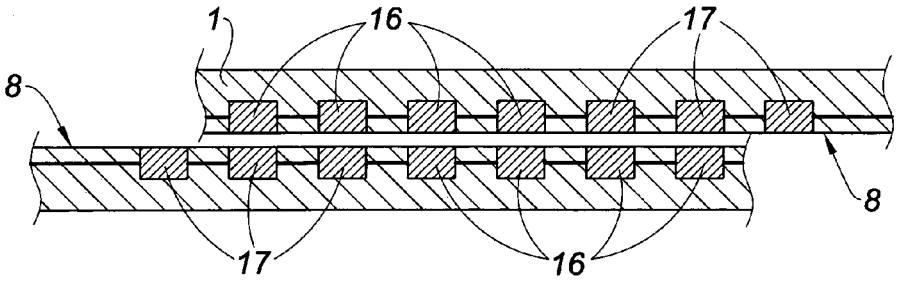
FIG. 2 shows a diagrammatic view of the belt of FIGS. 1*a* and 1*b* in a particular adjustment position.

In reference to FIGS. 1*a*, 1*b*, 2, a magnetic clasp device according to the invention is shown placed on a belt 1.

In general, this magnetic clasp device includes several elements fastened in a specific number along the length and with a predefined spacing on the two opposite surfaces of the belt, having each of the opposite ends of the belt 1 on the opposite surfaces as starting point, so as to make them cooperate when the belt 1 is closed.

One of the first elements fastened in specific number is a permanently magnetized assembly.

Figure 3A:
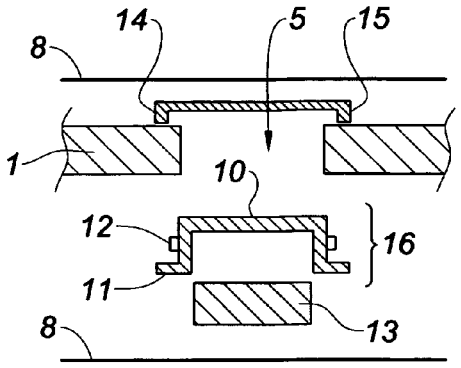
FIGS. 3*a* and 3*b* are cross-sectional and exploded perspective views, respectively, of one embodiment of a permanently magnetized assembly of the hidden magnetic clasp device of the belt of FIGS. 1*a* and 1*b;*
Figure 3B:
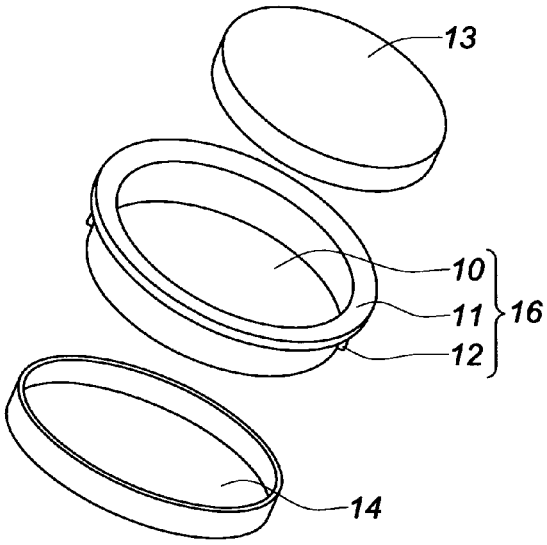

In one embodiment, this permanently magnetized assembly includes at least one permanent magnet 13 on the one hand, and on the other hand, an open receptacle 16 (only illustrated in FIGS. 1*a* and 1*b*) designed to house said magnet 13, which will be more specifically described in reference to FIGS. 3 and 4 in particular.

Preferably, but not limitingly, the magnet 13 is a permanent flat magnet, of the neodyme type (rare earths).

The receptacles 16 are preferably made from a ferromagnetic material.

The receptacles 16 are therefore machined as a function of the dimensions and shape of the chosen magnets 13, so as to form a second skin around the magnets 13.

Once the magnets 13 are fastened within the corresponding receptacles 16, they no longer have any mobility and only one of the surfaces of the magnets 13 remains free and visible, the magnets 13 being flush with the receptacle 16 on the open side.

Such a receptacle 16 is intended to protect the associated magnet 13 from impacts while maintaining it, but also to serve as fastening for said magnet on the belt 1 and to increase the attraction force (magnetic force) on the open side and to cut it on the bottom side of the receptacle 16, so as to thereby use more subtle magnets 13 while preserving a significant magnetic force.

The desired attraction force depends on the nature of the magnets 13 used, the dimensions of the receptacle 16, for example thickness, and the material of the latter part.

The thickness of the bottom of the receptacle 16 therefore varies as a function of the desired magnetization for the magnet 13 on the open side, while remaining capable of cutting it on the bottom side.

In one non-limiting example of the present invention, the material of the receptacle 16 is pure iron, so as to create better attraction of the magnet 13 on the open side relative to an alloy.

In one alternative embodiment of the permanently magnetized assembly, it is also possible to provide an element (not illustrated in FIGS. 1*a*, 1*b* and 2) made from a non-magnetic material with a shape complementary to that of the receptacle 16 and dimensions adapted (wider and thinner) to be fastened behind the receptacles 16 on the surface of the leather opposite that receiving the magnet 13.

This non-magnetic element can be used for fastening to the receptacles 16 and makes it possible to cut the rest of the magnetization that may be present.

This non-magnetic element will be described more specifically relative to FIGS. 3 and 4 in particular. It may, however, assume other forms depending on the embodiments.

Furthermore, other elements being able to be fastened in a specific number on one and/or the other of the surfaces of the belt 3 are ferromagnetic elements 17.

The receptacles 16 provided with magnets 13 and the ferromagnetic elements 17 are respectively fastened in holes 5, 7 made beforehand in the inner leather of the belt 1, not yet covered with finishing leather, that will be used as base.

The holes 5 called upon to receive the receptacles 16 provided with magnets 13 may pass all the way through said leather, the receptacles being higher than the ferromagnetic elements 17.

As illustrated in FIGS. 1*a* and 1*b*, starting from a first end 2 and a first surface of the belt 1, which we will call inner surface thereof, over a predefined length, on the portion folding down on the other opposite surface of the belt 1, and leaving a small margin 4 (which is not mandatory), several receptacles 16 provided with magnets 13, for example four in this case, are centered and fastened next to one another in the holes 5, in the lengthwise direction of the belt 1 and respecting a same spacing 6 from center to center between two adjacent receptacles 16.

They are preferably glued.

The magnets 13 are secured in the receptacles 16 in an adapted manner with the same polarity direction.

They are preferably glued.

Furthermore, a non-magnetic element 14 is then fastened behind each receptacle 16 in the leather by the other surface.

In the continuation of these receptacles 16, several ferromagnetic pieces 17 are fastened in holes 7 with a spacing 6 identical to that of the receptacles 16 provided with magnets 13.

In this alternative embodiment, the number of receptacles 16 provided with magnets 13 is proportional to the number of ferromagnetic elements 17 on a same surface.

A ferromagnetic element 17 is provided for each magnet 13 of a surface that is not connected to a magnet 13 of the other surface depending on the different clasps provided by the magnetic clasp device.

In one alternative embodiment, a proportion of at least one more receptacle 16 provided with a magnet 13 than there are ferromagnetic elements 17 on the same surface is followed, such that at least one magnet 13 of a surface is connected with a magnet 13 of the other surface, irrespective of the tightening level chosen.

In the illustrated example, there is therefore one less ferromagnetic piece 17 than there are receptacles 16, i.e. three on the inner surface of the belt 1.

It should be noted that the number of receptacles 16 or ferromagnetic elements 17 is not fixed, but remains proportional to the length of the desired size adjustment of the belt 1, the number of possible size adjustments being equal to the number of ferromagnetic elements 17 plus one unit on a surface of the belt 1.

"Number of possible size adjustments" refers to size adjustments benefiting from all aspects for which the system is provided, i.e. during closing, the ends of the belt are magnetically maintained, the magnets 13 of one surface are always connected with a magnet 13 of the opposite surface or ferromagnetic elements 17, and both closure and removal are simplified.

Furthermore, the center-to-center spacing is identical between each piece (receptacle 16 and ferromagnetic elements 17), and the arrangement is respected identically on each of the opposite surfaces of the belt 1.

In the non-limiting example illustrated in FIGS. 1*a* and 1*b*, the number of receptacles 16 provided with magnets 13 and ferromagnetic elements 17 is identical on each of the opposite surfaces of the belt 1.

On the opposite surface of the belt 1, which we will call the outer surface thereof, starting from the other end 3, i.e. the end opposite the first aforementioned end, the operation is repeated identically.

In this way, several ferromagnetic elements 17 and/or permanently magnetized assemblies, and more particularly receptacles 16 provided with permanent magnets 13, are arranged longitudinally so as to cooperate with the receptacles 16 and associated magnets 13 and/or ferromagnetic elements 17 of the other surface, irrespective of the adjustment position of the two relative opposite surfaces of the belt.

While respecting the same number of receptacles 16 provided with magnets 13 and ferromagnetic elements 17, the same spacing and the same positioning, the magnets 13 placed on this outer surface have a reversed polarity relative to the magnets 13 of the other opposite surface, in order to create an attraction when the belt 1 is closed.

In this way, in this alternative embodiment, the magnets 13 are secured in the receptacles 16 so as all to have the same polarity on a same surface and opposite polarities from one surface to the other of the belt 1.

When the belt is tightened as illustrated in FIG. 2, a first end of a surface (upper surface, for example) is advanced on the opposite end of the other opposite surface (lower surface, for example) and, once the size adjustment is selected, at least two receptacles 16 provided with magnets 13 are brought together and engaged by magnetism.

The other component pieces of the magnetic clasp device corresponding to the selected tightening level are thus also engaged, thereby yielding several fastening points, a surface of the belt 1 then being fastened on the other surface thereof.

According to the invention, the magnets 13 and/or ferromagnetic elements 17 of each surface are thus arranged so that by superimposing the opposite ends of two opposite surfaces of the belt 1 on one another, one obtains several adjustment positions of the two surfaces relative to the position of those magnets 13 and ferromagnetic elements 17 representing several possible tightening levels of the belt 1, each magnet 13 of a surface being applied on a magnet 13 and/or ferromagnetic element 17 of the other surface in each of the adjustment positions.

The most ample tightening level of the belt 1, i.e. the first closing position, is achieved when all of the receptacles 16 provided with magnets 13 of a surface are connected to all of the receptacles 16 provided with magnets 13 of the other surface.

In the illustrated example, in the first closing position, i.e. the most ample closing position, four magnets 13 present in the receptacles 16 connect with the four magnets 13 of the other surface of the belt 1, thereby offering several, i.e. four in this case, closing points.

The pieces left free being the ferromagnetic elements 17, they therefore do not have any magnetization.

By advancing to a less ample adjustment position, one then obtains three magnets 13 of one surface on three magnets 13 of the opposite surface and one magnet 13 of each of the surfaces on a ferromagnetic element 17 of the other surface, i.e. then five closing points.

The last closing position, i.e. the tightest closing position, corresponds to a position in which all of the pieces of one surface are connected with all of those of the other surface, whether it be a magnet 13 or a ferromagnetic element 17.

FIG. 2 illustrates an adjustment position with six closing points.

Irrespective of the size adjustment of the belt 1, all of the receptacles 16 provided with magnets 13 are always connected either with other receptacles 16 provided with magnets 13, or with ferromagnetic pieces 17 of the opposite surface.

This offers the advantage of obtaining a magnetic clasp belt in which the outward magnetization is reduced and any magnetic field is closed.

Furthermore, one of the advantages of this embodiment, with a proportional relationship of the number of receptacles 16 provided with magnets 13 and ferromagnetic elements 17 on a same surface and identical from one surface to the other, is that the magnetic closing device allows the clothing accessory on which it is placed to become reversible, closing both from the left and the right, without any manipulation of the magnetic closing device.

Furthermore, advantageously, the maintenance force being less for a magnet 13 on a ferromagnetic piece 17 than a magnet 13 against a magnet 13, and knowing that when the magnetic clasp device is advanced by one tightening level, a cooperation of a magnet with a magnet of the opposite surface is lost; to overcome this loss, an additional magnet 13 on ferromagnetic element 17 closing point is gained relative to the previous tightening level, as described above.

In alternative embodiments, it is possible to provide a magnetic clasp device only including ferromagnetic elements 17 on one surface of the belt 1 while eliminating any permanently magnetized assemblies, in particular any receptacle 16 provided with a magnet 13 of that surface or vice versa.

Furthermore, each permanently magnetized assembly and, more particularly, the receptacles 16, the magnets 13 and associated non-magnetic elements, as well as each ferromagnetic element 17 can be fastened using any known fastening means to one another and on the belt 1.

They may be fastened in different ways depending on the fastening system, and different ways may be used within a same device depending on the desired output.

Non-limiting examples include fastening by screwing, riveting or gluing. They may also be machined with an integrated fastening system.

Whatever the fastening system chosen, the fasteners are preferably non-magnetic so as not to lead to outward magnetization of the magnetic clasp device.

Furthermore, as will be described relative to FIGS. 1 to 24, a clasp device according to the invention may be visible on a finishing leather 8, i.e. in particular the receptacles 16 provided with magnets 13 and the ferromagnetic pieces 17 are then visible on the finishing leather 8.

With the exception of an embodiment of the magnetic clasp device described in reference to FIGS. 14 to 21, this device can also be covered with said finishing leather 8 of the belt 1. This finishing leather must be flexible, thin and solid. Top stitches 20 may then be made around the receptacles 16 or reinforcing their maintenance and providing an outward visual indication, as illustrated in particular in FIG. 1*b*.

In alternative embodiments:

- only the ferromagnetic elements 17 may be visible;
- only the receptacles 16 provided with magnets 13 may be visible;
- only one of the surfaces of the belt 1 may be visible, the other being hidden under the finishing leather 8 of the belt 1;
- the receptacles 16 provided with magnets 13 and/or the ferromagnetic elements 17 may be visible or hidden, independently of one another and on a same surface;
- the fastening means may be visible or hidden. They may also be sheathed or covered so as to be very slightly visible under the material.

Furthermore, the ferromagnetic elements 17 and the permanently magnetized assemblies and, more particularly, the receptacles 16 provided with magnets 13 may be placed in the belt in blind or through holes.

The ferromagnetic elements 17, the magnets 13, the receptacles 16, the fasteners, and more particularly, the flat ferromagnetic elements may have distinctive signs: etching, color, decoration.

The arrangements of the magnetic clasp devices described above relative to FIGS. 1*a*, 1*b* and 2 also apply to the embodiments that will be described relative to FIGS. 3 to 26.

Furthermore, in the different embodiments that will be described more specifically in reference to FIGS. 1 to 26, the receptacles 16, magnets 13 or ferromagnetic elements 17 and non-magnetic elements are illustrated in the general shape of cylinders.

However, the cylindrical shape is not limiting and may vary depending on the desired aesthetics.

The use of cylinders offers good mobility of the material in which they are fastened.

Figure 4A:
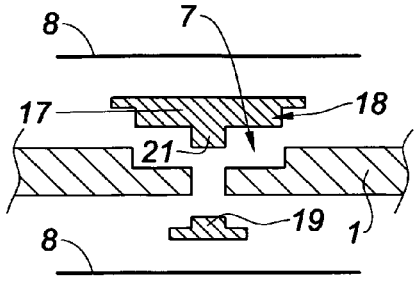
FIGS. 4*a* and 4*b* are respectively cross-sectional and exploded perspective views of one embodiment of a ferromagnetic piece of the hidden magnetic clasp device of the belt of FIGS. 1*a* and 1*b;*
Figure 4B:
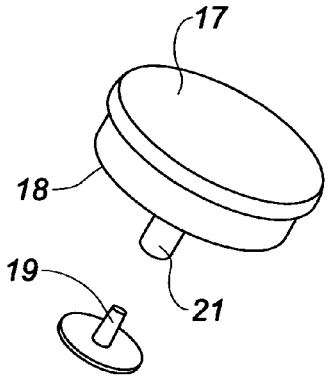
Figure 5:
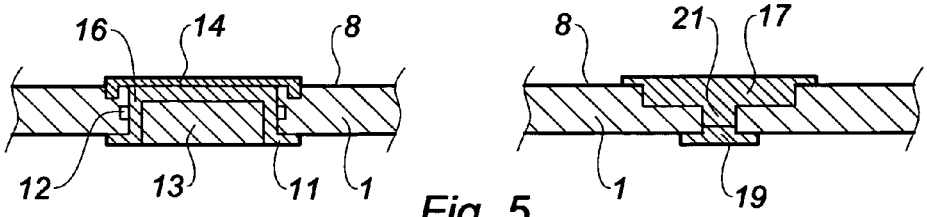
FIG. 5 is a cross-sectional view of the permanently magnetized assembly and the ferromagnetic piece of FIGS. 3*a* and 4*a* assembled.

In reference to FIGS. 1*a*, 1*b* and 2, a first embodiment of a magnetic clasp device is shown covered with finishing leather 8 that may include permanently magnetized assemblies and ferromagnetic elements hidden under the leather 8 as illustrated in FIGS. 3 to 5 in a first alternative embodiment.

As illustrated in FIGS. 3*a* and/or 3*b* and 5, each receptacle 16 intended to receive a permanent magnet 13 is fastened in one of the holes 5 made beforehand in the inner leather of the belt 1 not yet covered with finishing leather 8 following a specific arrangement as previously described relative to FIGS. 1*a*, 1*b* and 2, in particular on the portion called upon to close on the other, starting from the end 2 of the belt 1 and leaving a small margin 4.

Said hole 5 can pass all the way through the leather of the belt 1 through the thickness of said receptacles 16.

Preferably, each receptacle 16 is glued in the corresponding hole.

Each hole 5 has a diameter and a depth equal to those of the corresponding receptacle 16.

The cylindrical receptacle 16 includes a bottom 10 at one end and is open at the other end, thereby making it possible to define a housing intended to receive the magnet 13.

The dimensions of the housing are adapted to receive the corresponding magnet 13.

Preferably, the visible surface of the associated magnet 13 comes flush with the open side of the receptacle 16.

It should be noted that the magnets 13 are secured in the corresponding receptacles 16 in an adaptive manner with the same direction of polarity on a same surface and an opposite polarity from one surface to the other.

Furthermore, the receptacles 16 can be provided with small attachments or fasteners 12 on the outer circumferences thereof, for examples of the spur type, intended to be secured in the leather 1.

Each receptacle 16 can also include a peripheral edge or return 11 intended to rest on the surface of the corresponding leather on the visible surface of the magnet 13.

In one alternative embodiment, it is possible to provide an element made from non-magnetic material 14 with a shape complementary to that of the receptacle 16 and dimensions adapted to be fastened behind the corresponding receptacle 16 on the surface opposite the magnet 13, their base being fastened on the bottom 10 of the receptacle 16.

Preferably, the non-magnetic elements 14 are glued on the corresponding receptacle 16 while passing through the side of the hole 5 opposite the magnet 13.

This element 14, which is also cylindrical, has a generally straight U-shaped section and is thinner and wider than the corresponding receptacle 16.

The receptacles 16 are then maintained by the non-magnetic elements 14 on a side of the hole 5 and by their own edge of the other side of the hole 5.

As illustrated in FIGS. 4*a* and/or 4*b* and 5, each ferromagnetic element 17 is fastened in one of the holes 7 formed beforehand in the inner leather 1 of the belt not yet covered with finishing leather 8 according to a specific arrangement as previously described relative to FIGS. 1*a*, 1*b* and 2, i.e. in particular in the continuation of the holes of the receptacles 16, still with the same spacing 6, shallower due to the smaller thickness of the ferromagnetic elements 17, but allowing them to be completely inserted into the leather.

Preferably, they are glued in the holes 7.

Furthermore, the pieces, whether the receptacles 16 or the ferromagnetic elements 17, may have different size characteristics on a same device, and the holes are therefore made as a function of these differences and here, for example, make it possible to insert the different pieces into the leather.

Each ferromagnetic element 17 assumes the form of a flat cylinder with a generally T-shaped section.

The base of the T forms a hollow base fastening 21 for the ferromagnetic element adapted to cooperate with fastening means 19 placed on the opposite surface of the leather 1 or through the back of the hole, on the closed side of the hole 7.

Preferably, the base of the T is adapted to receive this fastening means 19 of the stud type and fasten the shaft thereof.

This fastening means 19 also includes a head or flange intended to rest on the surface of the leather on the closed side of the hole 7, while the ferromagnetic cylinder 17 includes a peripheral shoulder 18 adapted to rest on the surface of the leather on the open side of the hole 7.

Once the receptacles 16 and the ferromagnetic elements 17 are fastened in the corresponding holes of the leather 1, the assembly is covered with finishing leather 8, which is either glued or sewn on the leather on either side of the belt 1.

Top stitches 20 can be made around the receptacles 16 provided with magnets 13 and ferromagnetic elements 17 further consolidating the assembly and providing a visual indication.

This arrangement is done on the two opposite surfaces of the belt 1, i.e. in particular on the upper surface and starting from the opposite end 3 of the belt, while leaving an identical margin 4, identical holes 5, 7 are made while respecting the same spacing 6 relative to one another and the same arrangement, and the receptacles 16 are placed first starting from the end, followed by the ferromagnetic elements 17.

Figure 7A:
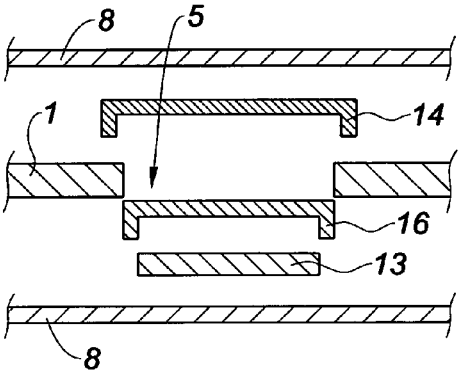
FIGS. 7*a* to 7*c* are cross-sectional views of alternative embodiments of the hidden permanently magnetized assembly of the magnetic clasp device of FIG. 3*a;*
Figure 7B:
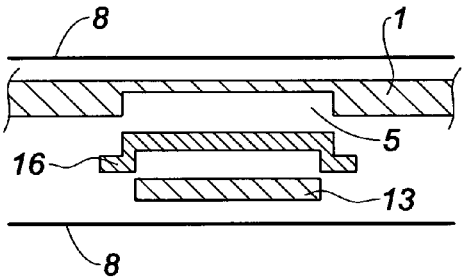
Figure 7C:
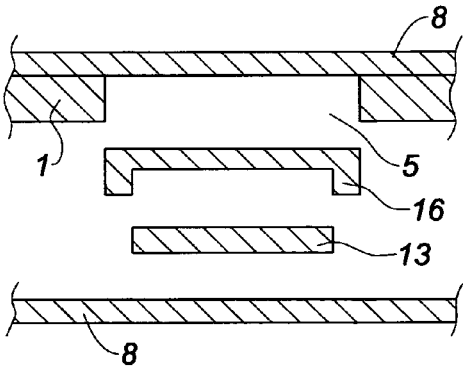

FIGS. 7*a* and 7*c* show alternative embodiments of the receptacle 16 illustrated in FIGS. 3 and 5.

In FIG. 7*a*, the return 11 and the spurs 12 of the receptacle 16 provided with a magnet 13 of FIG. 3*a* are eliminated.

In FIG. 7*b*, the receptacle 16 provided with a magnet 13 of FIG. 3*a* is placed in a blind hole 5 with adapted shape and dimensions. The spurs 12 of the receptacle 16 have also been eliminated.

FIG. 7*c* is identical to FIG. 7*c* with the following differences. The hole 1 of the belt 1 in which the receptacle 16 is inserted is a through hole and the peripheral return 11 of the receptacle is eliminated.

Figure 6A:
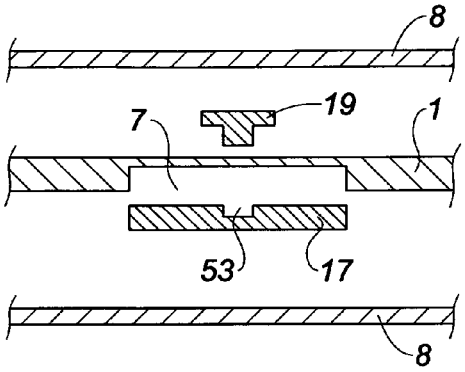
FIGS. 6*a* to 6*c* are cross-sectional views of alternative embodiments of the hidden ferromagnetic piece of the magnetic clasp device of FIG. 4*a;*
Figure 6B:
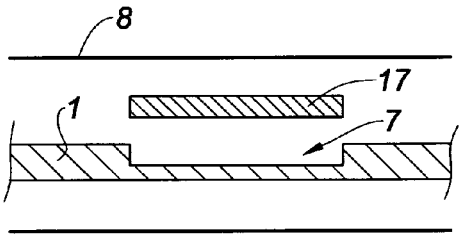
Figure 6C:
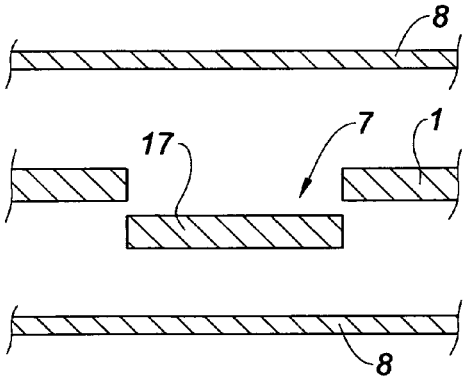

FIGS. 6*a* to 6*c* show alternative embodiments of the ferromagnetic elements 17 illustrated in FIGS. 4 and 5.

In FIG. 6*a*, the peripheral shoulder 18 adapted to rest on the surface of the leather on the open side of the hole 7 is eliminated.

Furthermore, the ferromagnetic element 17 includes a recess 53 on the surface opposite the fastening stud 19 intended to cooperate with said stud previously described.

In FIGS. 6*b* and 6*c*, the ferromagnetic element 17 is a solid flat cylinder whereof the shape and dimensions are adapted so that it is respectively inserted into a blind hole and through hole of the leather 1 before any covering of the finishing leather 8 on either side of the leather 1. Any fastener 19 is eliminated, the maintenance being obtained owing to the covering with the finishing leather 8.

Figure 8:
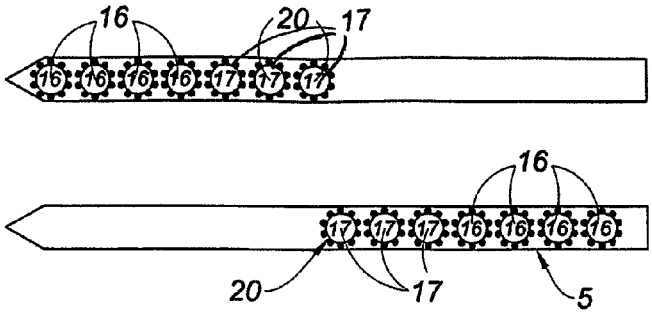
FIG. 8 is a view of a belt provided with a visible magnetic clasp device according to one embodiment of the present invention after deposition of a finishing leather on the belt.

FIGS. 8 to 10 show a second embodiment of a magnetic clasp device in which the receptacles 16 provided with magnets 13 and the ferromagnetic elements 17 are visible.

Holes 5, 7 are made while respecting the same arrangement in the leather 1 as those of the embodiments of FIGS. 1*a* and 1*b*.

The arrangement in the holes 5, 7 of the belt can also be identical to that of the embodiments of FIGS. 1*a* and 1*b* with or without a similar number of magnets 13 and ferromagnetic elements 17.

Figure 9A:
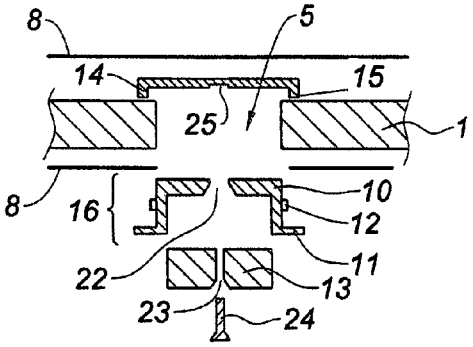

In a first alternative embodiment of the receptacle according to this embodiment illustrated in FIGS. 9*a* and 9*b*, the receptacle 16 is identical to that of FIG. 3*a* with the exception of the following differences.

The receptacles 16 in the form of cylinders open at one end and including the bottom 10 are machined with open side edges and the hole 22 passing through the bottom 10 thereof, like the magnets 13 that are housed therein whereof the hole is designated by reference 23.

In one non-limiting example, these holes 22, 23 can be beveled, so as to facilitate the insertion of screwing fasteners (screws) 24 adapted to cooperate with said holes.

The non-magnetic pieces 14 are machined with a hole 25, but only over part of their thickness, i.e. it does not go through the bottom or base thereof.

They are placed opposite the hole 5 of the corresponding leather on the surface opposite that where the receptacle 16 is located and are covered with finishing leather 8.

On the surface of the leather 1 intended to receive the receptacle 16, covering is done with finishing leather 8, said leather is then cut or cut beforehand before the covering at the holes 5, as illustrated in FIG. 8.

The receptacles 16 are then placed superimposing in the corresponding holes 5, the bottoms 10 thereof preferably being fastened by gluing in the corresponding non-magnetic elements 14 and their spur-type fasteners 12 inserted in the leather 1.

The magnets 12 are placed in the receptacles 16 while respecting the same polarity as before in reference to FIGS. 1*a*, 1*b* and 2.

The screwing means 24 of the screw type fasten the magnet 13, the dedicated receptacle 16, and the corresponding non-magnetic piece 14 together by entering through the hole of the magnet 13, passing through the hole 22 of the receptacle 16, and ending their journey in the blind hole 25 of the non-magnetic element 14.

This embodiment offers more maintenance, because there is direct contact between the different pieces during closing, as well as different aesthetics, since the device is visible.

Figure 10A:
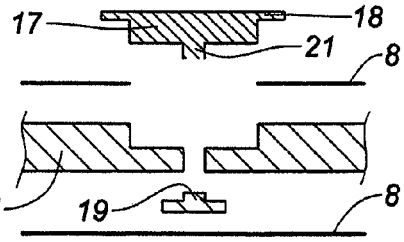

In this embodiment, the ferromagnetic elements 17 illustrated in FIGS. 10*a* and 10*b* are identical to those described relative to FIGS. 4*a* and 4*b* with the difference that the finishing leather 8 is inserted between the ferromagnetic elements 17 and the leather of the belt 1.

In this embodiment, the magnetic clasp device is visible and the fasteners, i.e. the stud 19 and the non-magnetic element 14, are hidden under the finishing leather 8.

Alternative embodiments of the permanently magnetized assemblies illustrated in FIGS. 9*a* and 9*b* are illustrated in FIGS. 12*a* to 12*e*.

Figure 12A:
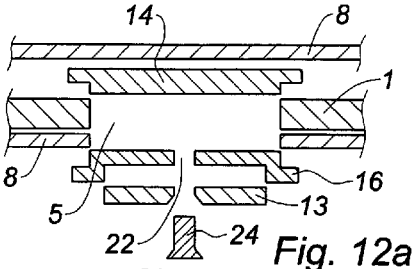
FIGS. 12*a* to 12*e* are cross-sectional views of alternative embodiments of the visible permanently magnetized assembly of the magnetic clasp device of FIG. 8.

In FIG. 12*a*, the receptacle 16 provided with a magnet 13 is identical to that of FIG. 9*a* in particular with the exception of the following differences, i.e. the spurs 12 are eliminated and the hole 22 is not beveled.

The non-ferromagnetic element 14 no longer has a U-shaped section, but a T-shape section and includes a non-through recess 54 in the center thereof, intended to receive the screwing means 24. The base of the T also has a width complementary to that of the hole 7 in the leather 1 of the belt so as to be inserted so that the bar of the T rests on the corresponding surface of the leather, as illustrated in FIG. 13*a*. The non-ferromagnetic element 14 is still hidden under the finishing leather 8.

Figure 12B:
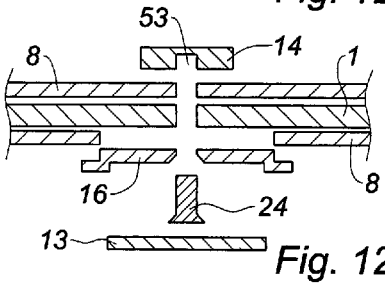

In FIG. 12*b*, the receptacle 16 is identical to that of FIG. 9*a* in particular with the exception of the following differences. It no longer comprises spurs 12 and it has a smaller height.

The magnet is solid, without a central hole 23.

The non-magnetic element 14 positioned opposite the magnet 13 of the other side of the receptacle 16 has a recess 53 similar to that of FIG. 12*a* and is no longer covered with finishing leather. It is thus visible.

This recess and the hole 22 of the receptacle are adapted to cooperate with screwing means 24 placed between the receptacle 16 and the magnet 13.

Figure 12C:
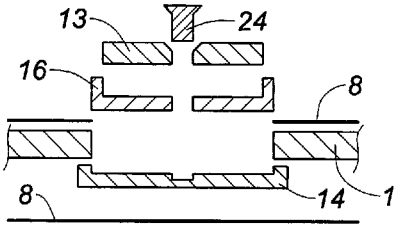

In FIG. 12*c*, the receptacle 16 is identical to that of FIG. 9*a* in particular with the exception of the following differences. It does not include spurs 12 or a return 11.

Figure 12D:
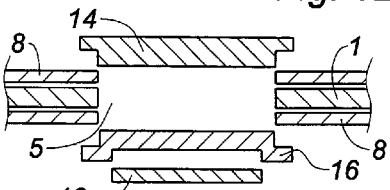

In FIG. 12*d*, the receptacle 16, the magnet 13 and the non-magnetic element 14 are similar to those of FIG. 12*a* with the exception of the following differences: they are solid without openings, the screwing means 24 being eliminated. Furthermore, the finishing leather 8 on either side of the hole 5 is pierced with a hole having dimensions similar to the hole 5 of the inner leather 1.

Figure 12E:
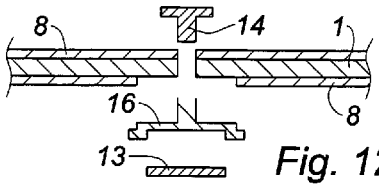

In FIG. 12*e*, the receptacle 16 is identical to that of FIG. 9*a* in particular with the exception of the following differences, i.e. it no longer has a hole 22, the spurs 12 have been eliminated, and it is machined with a fastener with a hollow base identical to the hollow base 21 of the ferromagnetic piece 16 of FIG. 4*a*.

The non-magnetic element 14 is shown here in the form of a screw with a head and a shaft.

Figure 11A:
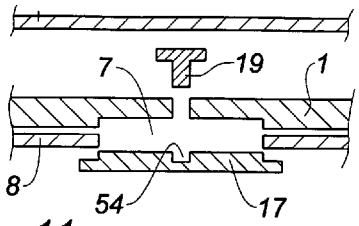
FIGS. 11*a* to 11*c* are cross-sectional views of alternative embodiments of the visible ferromagnetic piece of the magnetic clasp device of FIG. 8.
Figure 11B:
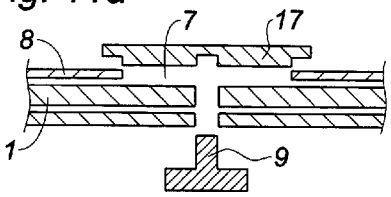
Figure 11C:
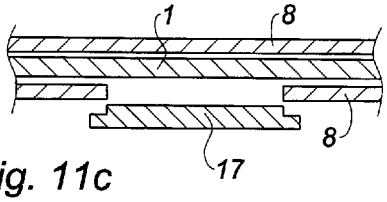

Furthermore, alternative embodiments of the ferromagnetic elements 17 illustrated in FIGS. 10*a* and 10*b* are illustrated in FIGS. 11*a* to 11*c*.

In FIGS. 11 and 13*a*, the ferromagnetic element 17 is similar to that described in FIGS. 4*a*, 4*b* with the following differences.

The hollow base fastening 21 is replaced by a recess 54 with a shape and dimensions adapted to receive the stud-type fastener 19.

Furthermore, the shoulder 18 may or may not be eliminated.

Furthermore, the hole 7 intended to receive the ferromagnetic element 17 may be a through hole or a blind hole.

Figure 13B:
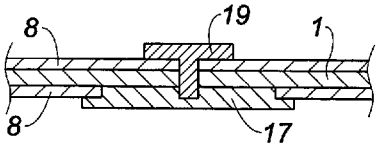
FIGS. 13*a* and 13*b* are cross-sectional views of the assemblies of the permanently magnetized assembly and the ferromagnetic piece of FIGS. 11*a* and 12*a* and FIGS. 11*b* and 12*b*, respectively.
Figure 13B:
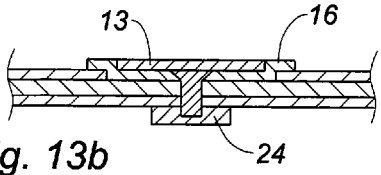
Figure 13A:
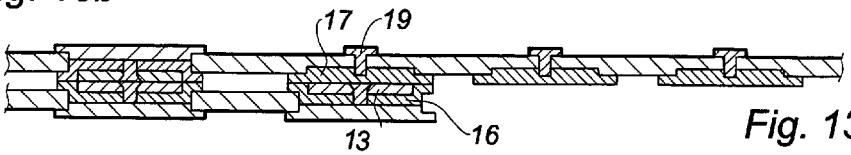

FIGS. 11*b* and 13*b* are similar to FIG. 11*a* with the difference that the stud 19 is no longer covered with finishing leather 8, but rather is visible.

In FIG. 11*c*, the ferromagnetic element 17 is solid and no longer cooperates with a stud 19. It is fastened in an opening 7 of the finishing leather 8 with a shape and dimensions adapted to retain it.

In a third embodiment, the magnetic clasp device includes receptacles 16 provided with visible magnets 13 and ferromagnetic pieces 17 hidden under the finishing leather 8.

In such an embodiment, through or blind holes are made adapted to allow the placement of the ferromagnetic pieces 17 under the finishing leather 8, these pieces 17 then being inserted or fastened in the holes and the assembly being covered with a finishing material.

These ferromagnetic pieces 17 preferably have a maximum height equals about of the material in which they are inserted.

They may either be fastened by simply covering with finishing leather 8, or by a dedicated fastening system.

It is also possible to produce holes in the finishing material before covering, said holes being intended for the bottom 10 of the receptacles 16 provided with magnets 13 and leading to savings in terms of thickness.

In this embodiment, the fasteners can also be visible. They may then serve to affix a mark or model depending on the clothing accessory.

This embodiment offers a very discreet clasp.

FIGS. 14 to 18 show a fourth embodiment of a magnetic clasp device in which permanently magnetized assemblies and more particularly the receptacles 27 of such an assembly of one surface are adapted to be inserted into the receptacles 29 of the permanently magnetized assemblies of the opposite surface.

As illustrated in FIGS. 14, 15*a*, 16*a* and 17*a* and 17*b*, this magnetic clasp device includes, on one of the surfaces, several, for example three, receptacles 27 provided with magnets 13 and on the opposite surface, several receptacles 29 provided with magnets 13 with different dimensions, for example seven. They may also be in a different form if necessary.

Figure 14:
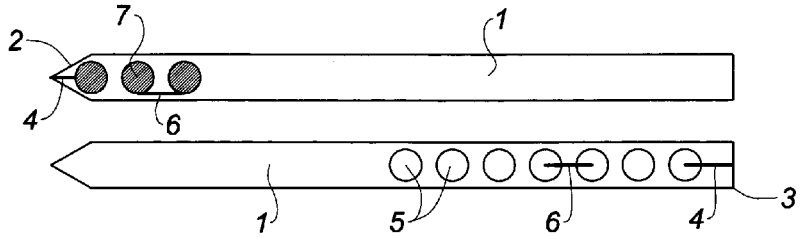
FIG. 14 is a view of the belt provided with a magnetic clasp device with a stop according to one embodiment of the present invention.

As illustrated in FIG. 14, the receptacles 27 are fastened in the holes 7 of a so-called upper portion surface of the belt, while the receptacles 29 are fastened in the holes 5 at the opposite end on the opposite surface, called lower portion, of the belt 1.

The arrangement of the receptacles respects the specific arrangement that was described relative to FIGS. 1*a*, 1*b* to 2.

In this embodiment, the diameter of the receptacles 27, 29 is different from one surface to the other.

Thus, when the belt 1 is closed, the receptacles 27 of the upper portion slightly enter the receptacles 29 of the opposite lower portion, which form a stop with their higher peripheral edges.

It should be noted that the number of receptacles 29 of the lower portion varies as a function of the adjustment length of the expected size, but must always be larger than that of the other opposite surface, i.e. the upper portion.

Figure 17A:
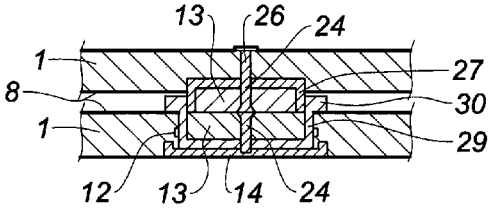
FIGS. 17*a* and 17*b* are views of assemblies of the permanently magnetized assemblies of FIGS. 15*a* and 16*a* after and before closing the magnetic clasp device with stop of the belt of FIG. 14, respectively.
Figure 16A:
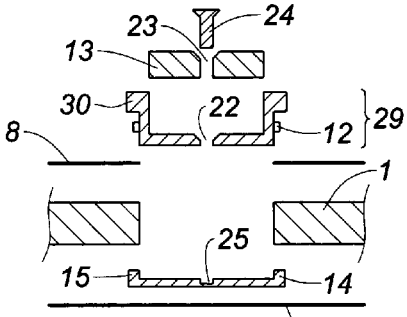
FIGS. 16*a* and 16*b* are cross-sectional and exploded perspective views, respectively, of one embodiment of a permanently magnetized assembly of the magnetic clasp device with stop of the belt of FIG. 14.
Figure 17B:
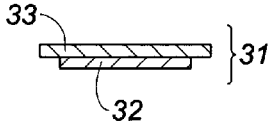
Figure 17B:
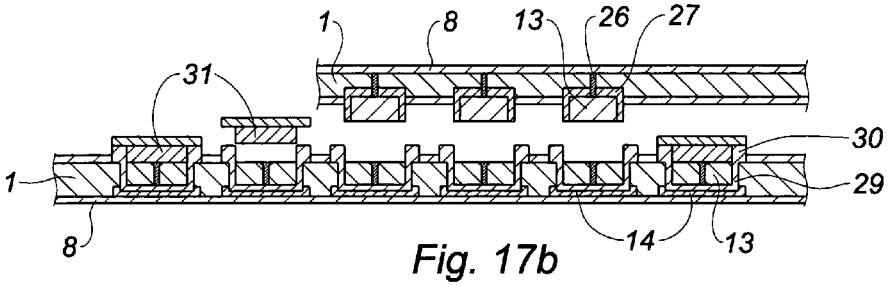

More specifically, in reference to FIGS. 16*a*, 17*a* and 17*b*, the receptacle 29, the magnet 13 that is housed therein, the screw-type screwing means 24, and the non-magnetic element 14 placed behind the receptacle 29 are similar to those described in reference to FIG. 9*a*.

The receptacle 29 is a hollow ferromagnetic cylindrical receptacle, machined with a through hole 22. The magnet 13 placed in the receptacle 29 is also machined with a hole 23.

Differences between this receptacle 29 and those of the aforementioned figures are higher peripheral edges, a larger thickness of the returns 30, and an inner diameter slightly larger than the outer diameter of the receptacles 27 of the opposite surface (upper portion) of the belt 1 with which they cooperate.

Figure 15A:
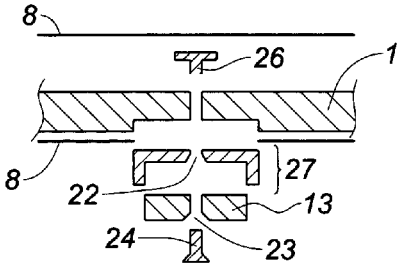
FIGS. 15*a* and 15*b* are cross-sectional and exploded perspective views, respectively, of one embodiment of a permanently magnetized assembly of the magnetic clasp device with a stop of the belt of FIG. 14.

The receptacles 27 of the opposite surface of the belt 1, illustrated in FIGS. 15*a*, 17*a* and 17*b* assume the form of hollow ferromagnetic cylinders, with a bottom, without an edge folded down on the leather, machined from a through hole 22 in that same bottom and provided with a non-magnetic fastening or attachment system 24.

More specifically, they are similar to those of FIG. 9*b* with the exception of the following differences.

The spur-type fasteners 12 and the returns 11 folding down on the leather 1 are eliminated.

The hole in the belt is blind. The depth of the holes is calculated so as to allow the housed receptacles 27 and magnets 13 to protrude slightly from the belt 1. The protrusion must be equal to the height of the edges of the receptacles 29.

The dimensions and, more specifically, the diameter of the magnets 13 is equal to the inner diameter of the corresponding receptacles 27, 29 in which they will be fastened, but they will have a similar thickness.

In this particular embodiment, the protrusion must thus correspond to the height of the edges of the receptacles 29, the receptacles 29 being higher than the receptacles 27, but receiving a magnet of the same thickness.

The non-magnetic element intended to cooperate with the receptacle 27 may assume the form of a stud 26 inserted behind the corresponding hole 5 and hidden under the finishing leather 8 whereof the hollow shaft is adapted to receive the screw-type screwing means 24.

Generally in this embodiment, the magnets 13 or fastened in their receptacles 27, 29 and always according to the appropriate polarities on the corresponding surface.

The receptacles 29 are preferably glued in the corresponding holes 5 of the belt 1 and on the other surface, the receptacles 27 are placed in the holes 7 and glued to the corresponding non-magnetic elements and their fasteners 12 inserted into the leather.

The assembly is covered with finishing leather 8, which is slightly cut out at the holes 5, 7.

In such an embodiment, as illustrated in FIGS. 17*a* and 17*b*, when the belt 1 is closed, the receptacles 27 of the upper portion slightly enter the receptacles 29 of the lower portion, which form a stop with their edges having larger dimensions.

The peripheral edges of these receptacles 29 may be non-magnetic, in this non-limiting example of the present invention.

The receptacles 27 of the upper portion must always be connected, while the receptacles 29 of the lower portion left free after closing at the desired size are covered with a flat cylinder 31 having a non-magnetic upper portion 33 and a ferromagnetic lower portion 32, so as to remain in place on the receptacles 29 left free and close the magnetic fields.

The fastener is magnetic due to the deposition of the cylinder 31 on the surface of the receptacles 29 containing the magnet 13.

These flat cylinders 31 are removable, and can be put back or removed at will during size changes, for example.

Figure 18:
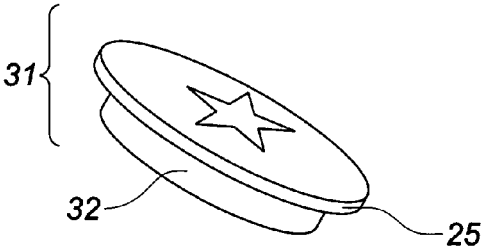
FIG. 18 is a perspective view of a ferromagnetic piece of the magnetic clasp device with stop of the belt of FIG. 14.

If they are decorated or etched as illustrated in FIG. 18, they can be changed to change styles.

One need only pull on the upper portion starting by the end to detach the assembly.

All of the pieces of this device are machined so as not to have sharp sides or surfaces for the user, and likewise for the material in which it is secured.

Figure 15B:
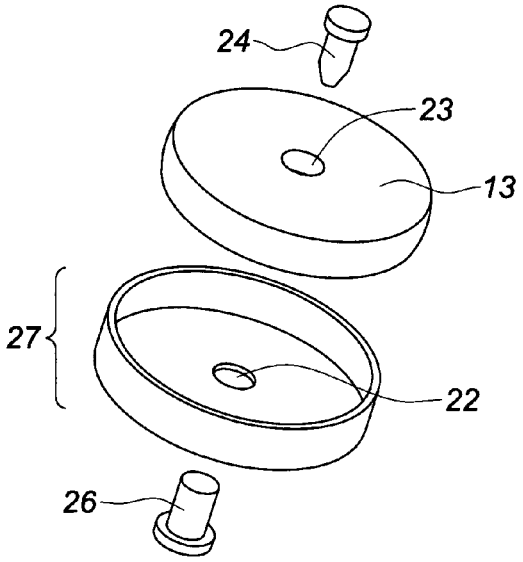
Figure 19A:
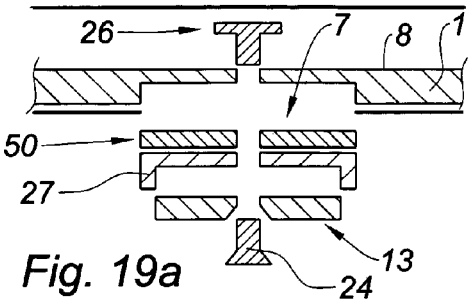
FIGS. 19*a* to 19*d* are alternative embodiments of the permanently magnetized assemblies of FIGS. 15*a* and 16*a;*

FIG. 19*a* illustrates one alternative embodiment of the permanently magnetized assemblies 27 of FIGS. 15*a* and 15*b* intended to be received in a receptacle of a lower surface of the belt 1.

Unlike the permanently magnetized assembly of FIGS. 15*a* and 15*b*, a non-magnetic element 50 is inserted between the receptacle 27 and the hole 7, allowing the receptacle 27 to protrude.

It is impossible to produce all of the holes 7 with an identical depth without having to take into account that certain elements must protrude and others must not, this piece serving to adjust the protruding position of the corresponding receptacle 27.

Figure 16B:
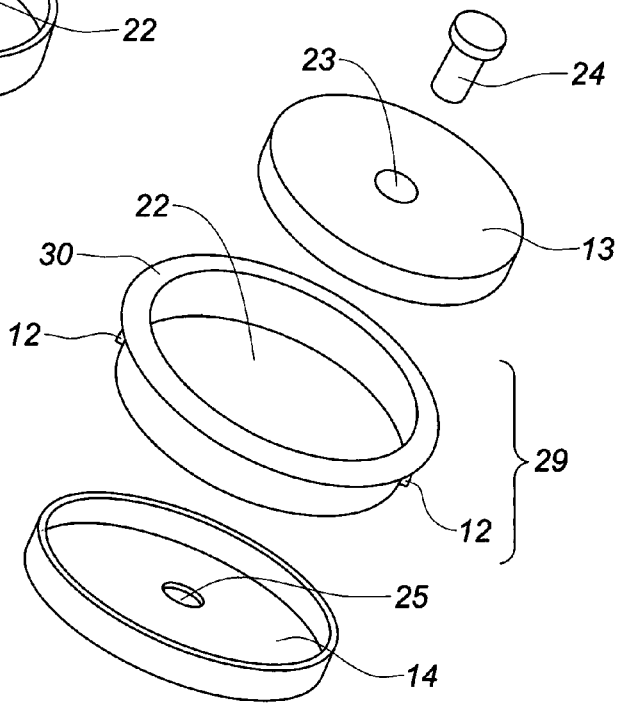
Figure 19B:
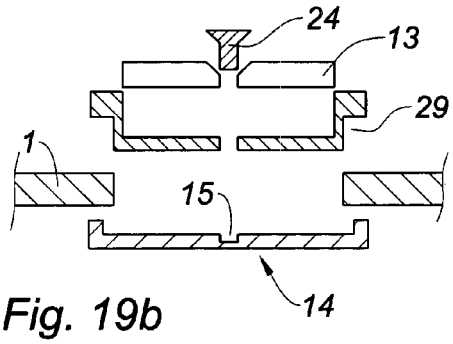
Figure 19C:
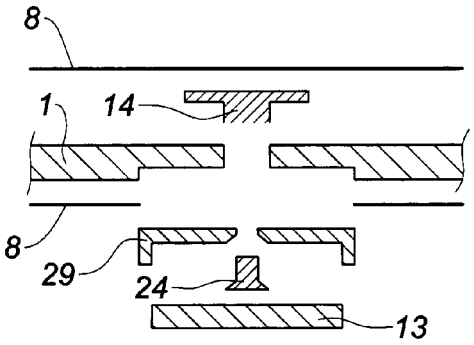
Figure 19D:
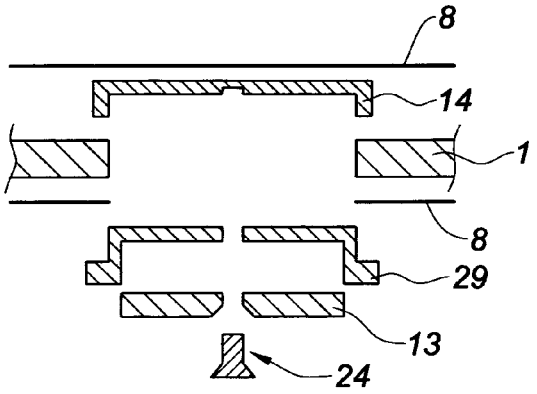

FIGS. 19*b* to 19*d* illustrate alternative embodiments of the permanently magnetized assemblies of FIGS. 16*a* and 16*b* intended to receive the receptacles 27 provided with magnets 13.

In FIGS. 19*b* to 19*d*, the spur-type fasteners 12 of FIG. 16*a* have been eliminated.

Unlike FIG. 19*b*, in FIG. 19*d*, the non-magnetic element 14 is hidden under the finishing leather 8.

In FIG. 19*c*, the screwing means (screws) 24 are inserted between the magnet 13 and the receptacle 29.

The peripheral edges 30 and the spur-type fasteners 12 of the receptacle 29 are eliminated.

Furthermore, the non-magnetic element 14 hidden under the finishing leather 8 here assumes the form of the stud whereof the hollow shaft is adapted to receive the screwing means 24.

In one alternative of this embodiment, it is possible to replace the removable cylinders 31 with ferromagnetic elements suitably fastened on the two surfaces of the belt.

Figure 20A:
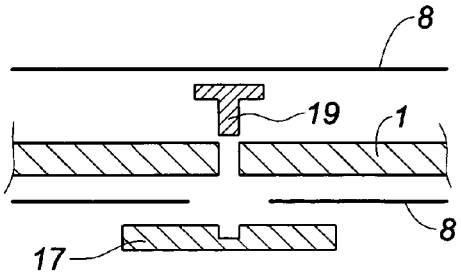
FIGS. 20*a* to 20*c* are cross-sectional views of several alternative embodiments of a ferromagnetic piece of the magnetic clasp device with stop of the belt of FIG. 14.
Figure 20B:
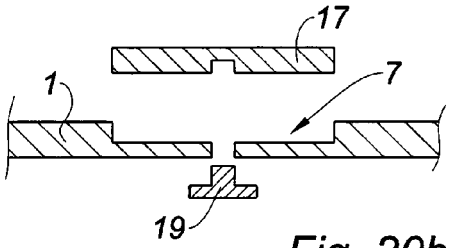
Figure 20C:
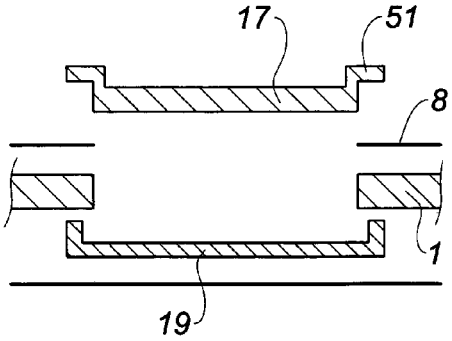
Figure 21A:
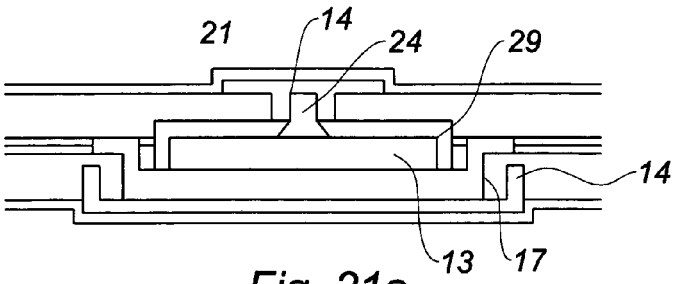
FIGS. 21*a* and 21*b* are views of assemblies of permanently magnetized assemblies and ferromagnetic pieces of FIGS. 20*c*, 19*c* and 19*d* and 20*a*, respectively.
Figure 21B:
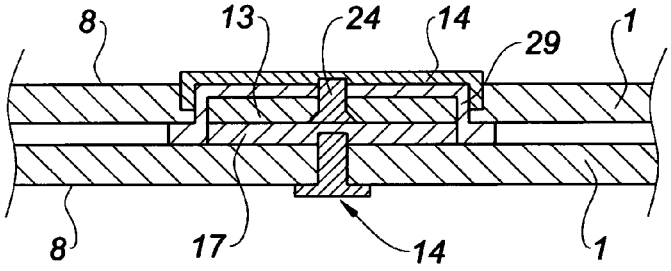

FIGS. 20*a* to 20*c* illustrate non-limiting examples of such ferromagnetic elements 17. These alternatives can be used in combination with any alternative of the receptacles 27 or 29, as illustrated by the assemblies of FIGS. 21*a* and 21*b*.

The ferromagnetic element of FIG. 20*a* is identical to that described in reference to FIG. 11*b* with the difference that the returns 11 resting on a surface of the belt are eliminated and the stud 19 is hidden under the finishing leather 8.

In FIG. 20*b*, the stud 14 is visible and the ferromagnetic element 17 similar to that of FIG. 20*a* is inserted into a blind hole 7.

In FIG. 20*c*, the ferromagnetic element 17 is visible and has a straight U-shaped section having returns 51 on the periphery thereof intended to rest on the finishing leather 8.

In one alternative embodiment, while respecting the arrangement (positioning) shown in FIGS. 1*a* and 1*b*, the receptacles 27 provided with magnets 13 as well as the ferromagnetic elements 17 of a surface are protruding and have a shape and dimensions adapted to cooperate with the other receptacles 27 and/or ferromagnetic elements 17 of said other surface.

In another alternative of this embodiment, while respecting the same positioning and the same proportion of the pieces, or one receptacle 27 more than there are ferromagnetic elements 17, the receptacles 27 provided with magnets 13 are visible and protruding on each of the surfaces of the belt 1, while the ferromagnetic pieces 17 are hidden according to the alternative of the embodiment of FIG. 6*c*.

Only one receptacle 29 provided with a magnet 13, on one of the surfaces, has characteristics able to allow the insertion of the receptacles 27 provided with magnets 13 of the other surface, said receptacle 29 will be fastened in the hole for the receptacle furthest from the end of the chosen surface, or just before the ferromagnetic pieces 17.

In fact, regardless of the tightening level chosen, and according to this proportion of one receptacle more than there are ferromagnetic elements 17 on a same surface and an identical number of elements on each of the surfaces, said receptacle 29 will only be in contact with the receptacles 27 of the other surface.

This offers the advantage of proposing a magnetic clasp device with a stop in which the ferromagnetic elements 17 are hidden.

According to the same embodiment, if two receptacles 29 provided with magnets 13 were used, they would be the two furthest from the end of the chosen surface, or the two closest to the ferromagnetic pieces 17, then, a ferromagnetic piece 17 of the other surface would have to be visible and protruding.

Irrespective of the preceding embodiments, the ferromagnetic elements 17 can have dimensions larger than those of the receptacles.

For this embodiment, it is also possible to replace said receptacle 29 with a visible ferromagnetic element 17 having characteristics able to allow the insertion of the receptacles 27 of the other surface.

According to the proportion of at least one receptacle more than there are ferromagnetic pieces 17 on a same surface, with the receptacles of each of the surfaces protruding from each of said surfaces and the hidden ferromagnetic pieces 17, the magnetic clasp device here includes two receptacles 29 more than there are ferromagnetic pieces 17, the two receptacles 27 furthest from the free end of one of the surfaces, or the two receptacles 27 closest to the ferromagnetic pieces 17, are adapted to allow the insertion of the protruding receptacles of the opposite surface aside from said receptacle present on each of the surfaces.

The number of possible size adjustment positions is always equal to the number of ferromagnetic pieces of a surface plus one unit.

FIGS. 22*a* to 24 show a fifth embodiment of a clasp device according to the present invention.

This device is applied to a buckle belt.

Traditionally, a buckle belt comprises a fixed prong or pin intended to pass through one of the holes 34 or eyelets for adjusting the size, the opposite end of which is provided, said end being intended to press above or below the end provided with the buckle.

A magnetic clasp device in such an application is adapted to keep the free end of the leather of the belt stationary by magnetism, once said free end has passed into the buckle and the belt has been closed.

It is also intended for secondary closing and makes it possible to maintain the suspended free end of the belt irrespective of the size adjustment of the belt.

Figure 22A:
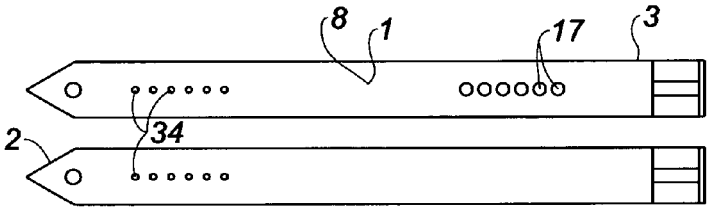
FIGS. 22*a* and 22*b* are views of a buckle belt provided with a magnetic closing device according to one embodiment of the present invention.
Figure 22B:
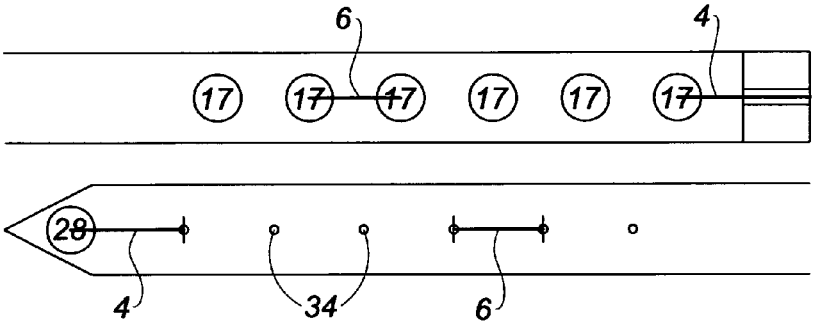
Figure 23:
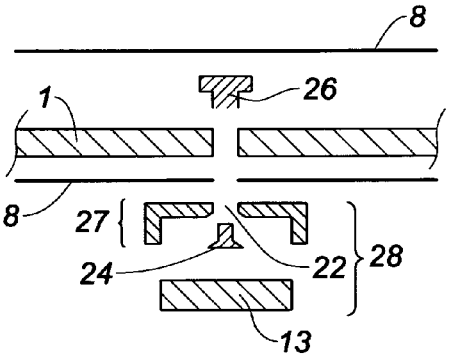
FIGS. 23 and 24 are cross-sectional views of a permanently magnetized assembly and a ferromagnetic piece of the magnetic clasp device of the belt of FIG. 22*a*, respectively.
Figure 24:
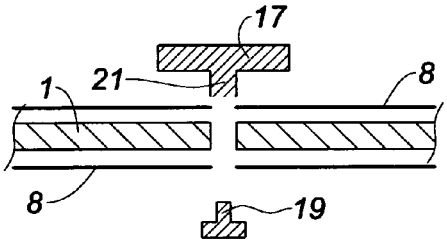

As illustrated more particularly in FIGS. 22*a* and 22*b*, at least one permanently magnetized assembly 28 (and more particularly a receptacle 27 provided with the associated magnet 13 as illustrated in FIGS. 23 and 24) is fastened on one surface of the belt (inner surface) at the free end 2 of the belt opposite the buckle, said end 2 being passed into the buckle of the belt, beyond the different holes 34 for adjusting the size of the belt.

Obviously, the open portion of the receptacles 16 provided with magnets 13 is positioned so as to make it cooperate with the other pieces.

Starting from the end 3 provided with the loop while leaving a margin 4, and on the surface (outer surface) opposite that of the permanently magnetized assembly, fastened, in the lengthwise direction of the belt, are ferromagnetic pieces or elements 17 in a number equal to or greater than the number of size adjustment holes 34 of the other surface.

This margin 4 has a length equivalent to the arrival of the opposite end 2 on the surface of the end 3, once passed through the buckle in the first hole 34 for adjusting the size.

The spacing 6 between the flat ferromagnetic pieces 17 is equal to the spacing 6 between the size adjustment holes 34 so that the magnet 13 of the permanently magnetized assembly can be magnetically pressed on a ferromagnetic element 17 irrespective of the hole 34 used so as to obtain magnetic maintenance of the end 2 of the belt or accessory once it is passed into the buckle and irrespective of the nature thereof.

The center of the first ferromagnetic piece 17, i.e. closest to the buckle, is defined by determining the distance between the center of the receptacle 27 at the center of the first size adjustment hole 34 of the other surface, i.e. that closest to the end.

This distance is passed on to the other surface starting from the arrival of the prong on the buckle, or spur depending on the nature of the buckle. This distance corresponds to the arrival of the magnet 13 present on the other surface and other end, once passed into the buckle and into the first size adjustment hole 34.

As for the ferromagnetic elements 17 of the preceding embodiments, the ferromagnetic pieces 17 can have sizes larger than the receptacle 1 of the permanently magnetized assembly.

This makes it possible to offset the fact that the portion of the belt or similar item passing over the other will cover more than the distance of that close to the body and therefore capable of causing a slight offset.

Preferably, a larger number of ferromagnetic pieces 17 than size adjustment holes 34 may be placed on the corresponding surface of the belt, this allowing the user to be able to adjust the holes and preserve the functions of the magnetic clasp device.

The buckle itself will preferably be non-magnetic so as not to bother during the passage of the end having the magnet 13 of the permanently magnetized assembly.

Such a device has the advantage of maintaining the ends of the belt by magnetism once the latter has passed into the buckle without using the carrier, as more particularly illustrated in FIGS. 22*a* and 22*b*.

Furthermore, irrespective of the size adjustment of the belt 1, the magnets 13 of the permanently magnetized assemblies 28 are always connected to a ferromagnetic element 17, thereby not leaving any outside magnetization, the open magnetic fields then not being able to damage devices or bother the user.

As in the other embodiments, the different component pieces of this magnetic clasp device can be visible or hidden under the finishing leather 8.

It suffices to insert or fasten these pieces in the inner material of the belt before any covering with the finishing leather 8.

One particular embodiment of a permanently magnetized assembly and a ferromagnetic element are illustrated, more particularly in FIGS. 23 and 24.

As illustrated in FIG. 24, the flat cylindrical ferromagnetic element 17 is identical to that described in reference to FIG. 10*a* with the difference that it does not include the shoulder 18.

Furthermore, the inner leather 1 does not include a blind hole or a through hole. Furthermore, the ferromagnetic elements 17 and their non-magnetic stud-type fastener 19 are visible.

Regarding the permanently magnetized assemblies 28, the ferromagnetic receptacles 27, provided to maintain a neodyme-type magnet 13, are machined with or without an edge, as illustrated in that figure and provided with a hole 22 passing through the bottom thereof.

This receptacle 27 is fastened on the end of the leather piece in a hole made beforehand in the inner leather 1.

The permanently magnetized assemblies 28 are identical to those described in reference to FIG. 15, in particular with the exception of the following differences.

The magnet is solid without holes and the screw-type fastener 24 is inserted between the magnet 13 and the receptacle 2.

In alternative embodiments, other types of permanently magnetized assemblies 28 or ferromagnetic elements may be proposed.

In this way, certain alternative embodiments may, more particularly and non-limitingly, provide permanently magnetized assemblies such as those illustrated in reference to FIGS. 12*c* and 12*d* and/or ferromagnetic elements 17 such as those illustrated in FIGS. 6*c*, 11*b* and 11*c*.

Figure 25A:
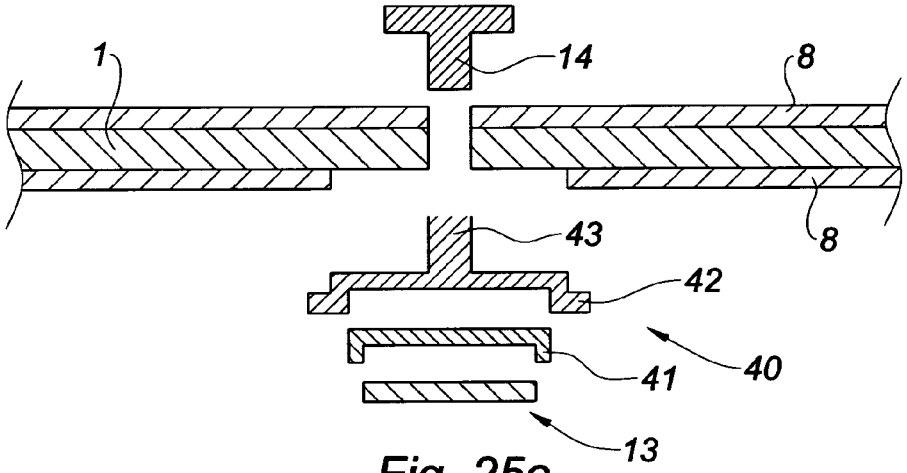
FIGS. 25*a* and 25*b* are cross-sectional views of another embodiment of the permanently magnetized assembly of a magnetic clasp device according to the present invention, before and after assembly, respectively.
Figure 25B:
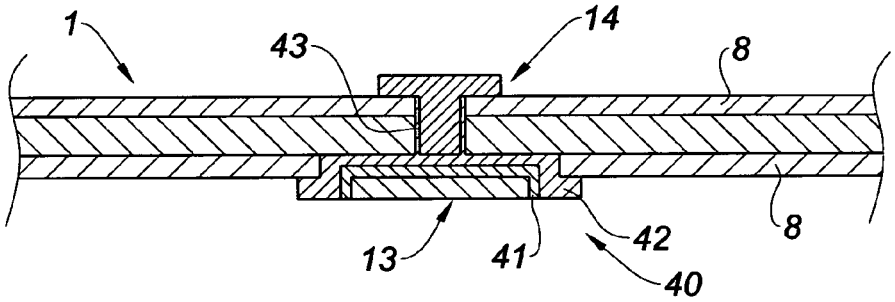

In a sixth embodiment illustrated in FIGS. 25*a* and 25*b*, a magnetic clasp device according to the invention may include a permanently magnetized assembly 40 including a double receptacle adapted to receive a magnet 13.

More specifically, a first U-shaped receptacle 41 is adapted to receive the magnet 13 and a second receptacle 42 has a shape and dimensions adapted to house the first receptacle 41.

Preferably, the first receptacle 41 is made from a ferromagnetic material, while the second 42 is made from a non-magnetic material, so as to obtain even more precise positioning of the magnets on a magnet during closing.

Furthermore, it is then easier to produce non-magnetic edges for a system with a stop; in fact, only the receptacle 42 would be machined with edges.

The assembly of these two receptacles 41, 42 in a single unit makes it possible to keep the advantages of the ferromagnetic elements, which are cutting the magnetization on the bottom side and reinforcing it on the open side while benefiting from non-magnetic edges, then in no way creating a bother during the insertion of the other receptacles provided with magnets 13 of the upper surface.

Furthermore, they are visible on the finishing leather 8 of the belt 1, and the latter is pierced with an opening adapted so that a hollow shaft 43 adapted to cooperate with a non-magnetic element 14 of the stud type placed on the other side of the belt and receive it can pass through the belt 1.

Figure 26A:
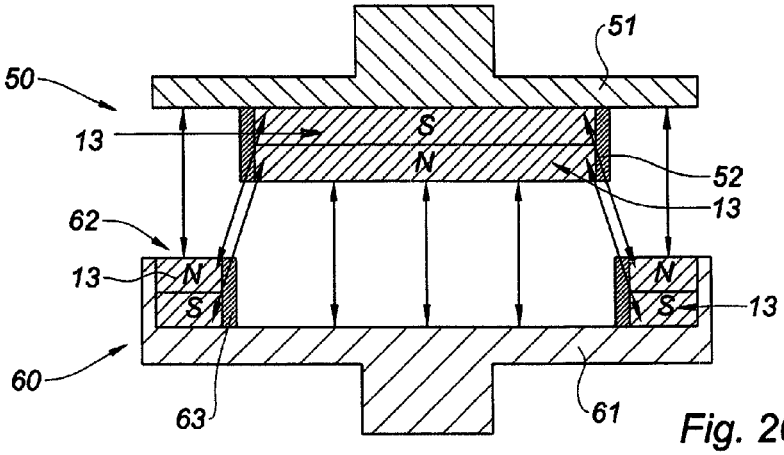
FIGS. 26*a* to 26*c* are cross-sectional views of a magnetic clasp device according to another embodiment of the present invention.
Figure 26B:
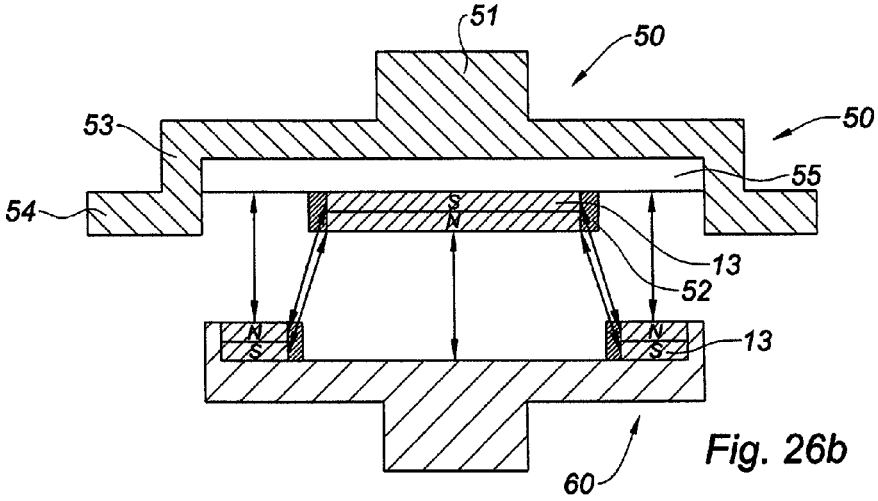
Figure 26C:
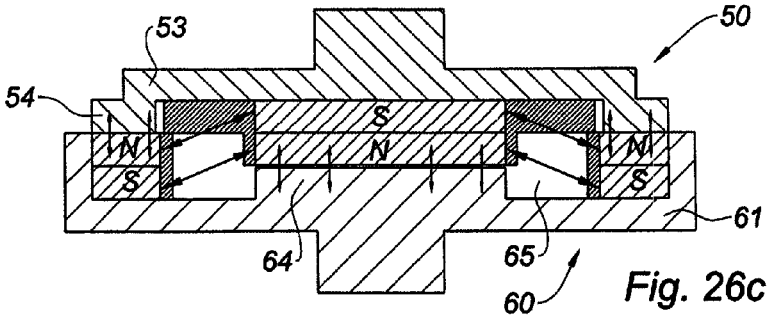

FIGS. 26*a* to 26*c* show another embodiment of permanently magnetized assemblies of a clasp device according to the present invention that may be mounted on each of the two surfaces of the belt 1.

In reference to FIG. 26*a*, a first permanently magnetized assembly 50 is shown adapted to cooperate with a second permanently magnetized assembly 60, each of said permanently magnetized assemblies 50, 60 respectively including a permanent magnet 13 fastened so as to have the same pole on their visible surface arranged so as to attract one another.

In this way, they each include a receptacle 51, 61 adapted to house the corresponding magnet 13 and having at least one ferromagnetic portion made to cooperate with the magnet 13 of the opposite receptacle of the permanently magnetized assembly facing it.

Said receptacles 51, 61 are preferably ferromagnetic.

These receptacles 51, 61 are machined as a function of the magnet 13 they support, but also as a function of the magnet 13 of the opposite receptacle 61, 51 with which they will have to cooperate.

These permanently magnetized assemblies 50, 60 are visible and, preferably, the magnets 13 of said permanently magnetized assemblies are fastened on the belt so as also have the same polarity on their visible surface.

In one alternative of this embodiment, the magnets 13 of the first and second permanently magnetized assemblies 50, 60 respectively cylindrical and in the shape of a ring or annulus 62.

Said magnets 13, 62 preferably have an identical height and are both axial magnetization magnets.

To produce this device, one of the two magnets, here the annulus 62, must have a through central opening with a diameter adapted to receive the magnet 13 of the first permanently magnetized assembly 50, i.e. slightly larger than the outer diameter of the magnet 13 facing it.

It is also desirable for the shape of the magnets 13, 62 to be complementary.

More precisely, the first permanently magnetized assembly 50 thus includes a ferromagnetic receptacle 51 with a generally T-shaped section, on which a magnet 13 rests having, in one non-limiting example, its north polarity on its visible surface.

This receptacle 51 has an axial extension at the base of the T intended to be inserted into the leather of the belt.

Said base can be hollow or solid so as to cooperate with the desired fastening system.

Once the magnet 13 is secured, it does not take up the entire surface area of the receptacle 51 present at its base, the portion of this surface area protruding beyond the outer diameter of said magnet being equal to or larger than the outer diameter of the annulus 62 of the second permanently magnetized assembly 60.

Furthermore, the assembly includes a paramagnetic element 52 adapted to extend over the outer periphery of the magnet 13.

In the illustrated non-limiting example, the magnet 13 is in the shape of a cylinder and the paramagnetic element 52 is in the shape of an annulus encircling said magnet 13.

This paramagnetic element 52 is intended to protect the magnets 13 and allow them to preserve their dimensions.

It should be noted that in this alternative embodiment, the diameter of the paramagnetic element 52 is much smaller than the diameter of the ferromagnetic receptacle 51.

The second permanently magnetized assembly 60 includes a generally U-shaped ferromagnetic receptacle 61, with an axial extension at the base of the U intended to be inserted into the leather of the belt.

Said base will also be machined as a function of the selected fastening system.

The branches of the U form the peripheral edge of the receptacle 61.

On the inner circumference of this peripheral edge, the generally ring-shaped magnet 62 is mounted having the same direction of polarity as that of the first assembly 50, or a north polarity on its visible surface.

A ring-shaped paramagnetic element 63 is mounted in the central opening passing through the ring 62.

The inner diameter of the paramagnetic element 63 is adapted to (or larger than) the outer diameter of the paramagnetic ring 52 secured around the magnet 13 of the first permanently magnetized assembly 50 so that the latter can be inserted and guided in the second permanently magnetized assembly 60.

Furthermore, the height of the paramagnetic elements 52, 63 is equal to the height of the magnets 13 and 62, respectively, of the permanently magnetized assemblies 50, 60.

Knowing that the magnets 13, 62 preferably have a same height, and that in this embodiment they have an identical height, the same is true for the paramagnetic elements.

These elements of the magnetic clasp device according to the invention simultaneously use the following phenomena, i.e. the repulsion of the identical poles present on the visible surfaces of the magnets 13, 62, the mutual attraction of the opposite poles present on the thickness of the edges of the magnets, or on the inner diameter of the ring magnet 62 and on the outer diameter of the cylindrical magnet 13, as well as the attraction of the magnets on the ferromagnetic material present at the center of the ring 62 and around the cylinder 13.

The poles present on the outer diameter of the magnetic ring 62 do not in fact come into contact, their magnetic field being cut by the ferromagnetic edges of the receptacle 61.

These various phenomena are used jointly for the placement, centering, maintenance and production of the exterior magnetization of the device according to the present invention.

In this way, during closing of the belt, when the adjustment position of the clothing accessory has been chosen by the user, when the two permanently magnetized assemblies 50, 60 come closer together:

- the repulsion of the identical poles of each of the visible surfaces of the magnets 13, 62 of each of the permanently magnetized assemblies 50, 60 prevent the latter from being incorrectly positioned.
- At the same time, the poles present on the thickness of the outer diameter of the magnet 13 of the first assembly 50 are attracted by the opposite poles present on the thickness of the inner diameter of the magnetic ring 62 of the second assembly 60.
- Furthermore, the magnet 13 of the first permanently magnetized assembly 50 is attracted by the free ferromagnetic surface of the receptacle 61 of the second permanently magnetized assembly 60 opposite it and vice versa, the ring magnet 62 of the second permanently magnetized assembly 60 is attracted by the outer free surface opposite it of the receptacle 51 of the first permanently magnetized assembly 50.

In this way, the cooperation of the first and second permanently magnetized assemblies 50, 60 makes it possible to eliminate any outside help, except to bring them together, to insert and center one of the assemblies on the second. Furthermore, the permanently magnetized assemblies 50, 60 are vertically maintained on the peripheries thereof.

During closing, part of the assemblies, in this embodiment corresponding to the height of the magnets 13, 62, is inserted, thereby creating a stop preventing any unilateral withdrawal.

Furthermore, the cooperation of such permanently magnetized assemblies 50, 60 offers a clasp device whereof the outside magnetization is cut during closing. In fact, each of the magnets is connected to and surrounded by a ferromagnetic material.

It should be noted that the magnets of the two permanently magnetized assemblies 50, 60 have dimensions so as never to be withdrawn relative to the height of the corresponding receptacle.

This offers the advantage of being able to make them cooperate with hidden ferromagnetic elements like those described relative to FIGS. 1 and 6.

According to the preceding embodiments, and preferably at least one more receptacle than there are ferromagnetic pieces on each of the surfaces of the belt or similar item and the same number of receptacles and ferromagnetic pieces on each of the surfaces, the receptacles 51 provided with cylindrical magnets 13 are secured on one surface, while the receptacles 61 provided with magnetic rings 62 are secured on the other surface.

It should also be noted that the permanently magnetized assemblies 50, 60 are complementary and will therefore each be secured on opposite surfaces of the belt or accessory.

The use of circular or cylindrical pieces is provided as a non-limiting example.

In fact, these embodiments may assume other forms preferably with magnets having complementary shapes for the insertion, and at least one of the two magnets having a through opening allowing the insertion of the other magnet of the assembly.

The magnet with the through opening will preferably have surfaces, or its outer diameter less than its inner diameter, at least equal to its thickness.

Other alternative embodiments of the first and second permanently magnetized assemblies 50, 60 are illustrated in FIGS. 26*b* and 26*c*.

FIG. 26*b* is identical to FIG. 26*a* with the exception of the following differences.

The receptacle 51 of the first permanently magnetized assembly 50 is different.

The latter is made from a non-magnetic material, or paramagnetic material, and is in the shape of a T with a peripheral edge 53 protruding from the bar of the T extended by a return 54.

This receptacle is also associated with a ferromagnetic element 55 mounted in the concavity of the receptacle, said element having a shape and dimensions adapted to said concavity.

This element 55 is inserted between the receptacle 51 and the magnet 13.

It has a diameter larger than that of the magnet 13 plus that of the paramagnetic annulus 52, so that a free surface of said element 55 is intended to rest on the visible surface of the ring magnet 62 of the second permanently magnetized assembly 60.

FIG. 26*c* is identical to FIG. 26*a* with the exception of the following differences.

The receptacle 61 of the second permanently magnetized assembly includes a central disk protruding from the bottom of the receptacle 64 on which the magnet 13 of the first assembly 50 is intended to rest.

A circular groove is thus created between the magnet ring 62 and said disk 64.

Regarding the first permanently magnetized assembly 50, the diameter of the magnet 13 is adapted to that of the disk 64 protruding from the second assembly 60.

Furthermore, the paramagnetic element 52 is generally in the shape of an upside down L, one of the bars of the L resting in the concavity of the receptacle 50 left free between the paramagnetic element 52 and a peripheral edge 53 of the receptacle 51, said edge being extended as in FIG. 26*b* by a return 54 intended to rest on the magnetized rings 62 of the second assembly 60.

One skilled in the art will appreciate, relative to the known magnetic clasp devices, a magnetic clasp device making it possible to offer a series of positions for adjusting the size of the clothing accessory on which it is placed while meeting the requirements relative to personal safety and device-related safety within the periphery of the accessory, while guaranteeing that the magnetic clasp device operates in a closed magnetic circuit.

The invention claimed is:

1. A magnetic clasp device comprising:

a first receptacle;

a first magnet disposed on the first receptacle;

a first ferromagnetic element having a first ferromagnetic surface disposed on the first receptacle and arranged so as to surround an outer periphery of the first magnet, the first magnet extending axially from the first receptacle and from the first ferromagnetic surface;

a second receptacle;

a second magnet disposed on the second receptacle;

a second ferromagnetic element having a second ferromagnetic surface disposed on the second receptacle, the second magnet arranged so as to surround the second ferromagnetic surface, the second magnet extending axially from the second receptacle and from the second ferromagnetic surface;

wherein the first magnet has a first pole disposed adjacent to the first receptacle and a second pole disposed distally from the first receptacle;

wherein the second magnet has a first pole disposed adjacent to the second receptacle and a second pole disposed distally from the second receptacle;

wherein the first pole of the first magnet is the same polarity as the first pole of the second magnet;

wherein the second pole of the first magnet is the same polarity as the second pole of the second magnet;

wherein the first and second receptacles are arranged oppositely with the first and second magnets facing each other such that when the first and second receptacles are moved toward each other the second pole of the first magnet and the second pole of the second magnet are mutually repulsed;

wherein the first ferromagnetic surface is disposed oppositely from the second magnet such that when the first and second receptacle are said moved toward each other, the first ferromagnetic surface and the second magnet are mutually attracted;

wherein the second ferromagnetic surface is disposed oppositely from the first magnet such that when the first and second receptacle are said moved toward each other, the second ferromagnetic surface and the first magnet are mutually attracted; and wherein, when said repulsion is overcome during said movement of the first receptacle toward the second receptacle, the first pole of the first magnet and the second pole of the second magnet are mutually attracted and the first pole of the second magnet and the second pole of the first magnet are mutually attracted;

wherein the second magnet is annularly shaped and delimits a cavity on the second receptacle, wherein the second ferromagnetic surface forms on end of the cavity, the opposite end being open.

2. The device of claim 1, wherein the first magnet is shaped complimentary to the cavity and is received thereby during said movement of the first receptacle toward the second receptacle.

3. The device of claim 2, wherein the mutual repulsion of the annularly shaped second magnet and the complimentarily shaped first magnet is configured to direct the first magnet into a centered position relative to the second magnet such that the first and second magnets are axially aligned.

4. The device of claim 3, wherein the mutual attraction of the first magnet with the second ferromagnetic surface and of the second magnet with the first ferromagnetic surface is configured to draw the first magnet into the cavity in order to secure the first receptacle to the second receptacle in the axial direction and in a transverse direction normal to the axial direction.

* * * * *